US010071463B2

(12) United States Patent
Suzuki et al.

(10) Patent No.: US 10,071,463 B2
(45) Date of Patent: Sep. 11, 2018

(54) CENTRIFUGAL PROJECTOR

(71) Applicant: SINTOKOGIO, LTD., Nagoya-shi, Aichi (JP)

(72) Inventors: Hiroaki Suzuki, Toyokawa (JP); Masato Umeoka, Toyokawa (JP)

(73) Assignee: SINTOKOGIO, LTD., Aichi (JP)

( * ) Notice: Subject to any disclaimer, the term of this patent is extended or adjusted under 35 U.S.C. 154(b) by 27 days.

(21) Appl. No.: 15/032,876

(22) PCT Filed: Sep. 26, 2014

(86) PCT No.: PCT/JP2014/075726
§ 371 (c)(1),
(2) Date: Apr. 28, 2016

(87) PCT Pub. No.: WO2015/064263
PCT Pub. Date: May 7, 2015

(65) Prior Publication Data

US 2016/0236324 A1 Aug. 18, 2016

(30) Foreign Application Priority Data

Oct. 31, 2013 (JP) ..... 2013-226800

(51) Int. Cl.
*B24C 5/06* (2006.01)

(52) U.S. Cl.
CPC ..... *B24C 5/062* (2013.01); *B24C 5/06* (2013.01); *B24C 5/066* (2013.01); *B24C 5/068* (2013.01)

(58) Field of Classification Search
CPC .... B24C 3/26; B24C 3/30; B24C 5/06; B24C 5/062; B24C 5/066; B24C 5/068
See application file for complete search history.

(56) References Cited

U.S. PATENT DOCUMENTS 2,108,210 A * 2/1938 Rosenberger ..... B24C 3/30 451/102
2,116,160 A * 5/1938 Rosenberger ..... B24C 3/30 451/2

(Continued)

FOREIGN PATENT DOCUMENTS

BE 862 932 A1 5/1978
EP 2650084 A1 10/2013

(Continued)

OTHER PUBLICATIONS

Extended Search Report in corresponding European Application No. 14857071.6, dated May 3, 2017, 10 pages.

(Continued)

*Primary Examiner* — Eileen Morgan
(74) *Attorney, Agent, or Firm* — Brinks Gilson & Lione

(57) ABSTRACT

The centrifugal projector (1) of the present invention has: a side plate (11), a plurality of blades (3) attached to the side plate (11), a control cage (41-45) disposed on a radial inner side of the side plate for releasing the projection material between blades from an opening portion (41*a*-45*e*), a distributor (22), disposed on a radial inner side of the control cage, for mixing and supplying the projection material to the control cage, and a rotary shaft (14) for rotating the side plate, blades and distributor; wherein the blades are formed to be pitched so that a radial outer side (3*c*) thereof is positioned to a rear in the rotational direction (R1) compared to a radial inner side (3*b*) thereof; the control cage (41-45) has a plurality of opening windows (41*a*-45*e*), or a single opening window in which a portion or all of a plurality of opening windows are respectively overlapped and integrated into a single piece.

11 Claims, 13 Drawing Sheets

(56) References Cited

U.S. PATENT DOCUMENTS

| | | | | | |
|---|---|---|---|---|---|
| 2,204,633 | A | | 6/1940 | Turnbull | |
| 2,204,634 | A | | 6/1940 | Turnbill | |
| 2,224,647 | A | * | 12/1940 | Grocholl | B24C 3/04 451/95 |
| 2,440,819 | A | * | 5/1948 | Evans | B24C 3/30 451/3 |
| 2,449,745 | A | * | 9/1948 | Jewell | B24C 3/30 451/86 |
| 2,732,666 | A | * | 1/1956 | Powell | B24C 5/06 451/94 |
| 3,653,239 | A | | 4/1972 | Carpenter | |
| 3,683,556 | A | | 8/1972 | Leliaert | |
| 3,694,963 | A | * | 10/1972 | Leliaert | B24C 5/062 451/97 |
| 3,785,105 | A | | 1/1974 | Freeman | |
| 3,841,025 | A | | 10/1974 | Maeda | |
| 4,034,516 | A | | 7/1977 | Maeda | |
| 4,277,965 | A | * | 7/1981 | Rutten | B24C 5/062 451/98 |
| 4,366,690 | A | | 1/1983 | Rutten | |
| 4,697,391 | A | | 10/1987 | Carpenter, Jr. et al. | |
| 5,688,162 | A | | 11/1997 | Williams | |
| 5,888,125 | A | | 3/1999 | Kuehn | |
| 2013/0017767 | A1 | * | 1/2013 | Suzuki | B24C 3/085 451/86 |

FOREIGN PATENT DOCUMENTS

| | | | |
|---|---|---|---|
| GB | 518803 | A | 3/1940 |
| GB | 2 276 341 | A | 9/1994 |
| JP | S50-125887 | U | 10/1975 |
| JP | S 52-166898 | U | 12/1977 |
| JP | S53-108685 | U | 8/1978 |
| JP | 54-89391 | A | 7/1979 |
| JP | S57-202661 | U | 12/1982 |
| JP | S 60-157166 | U | 10/1985 |
| JP | S60-157166 | U | 10/1985 |
| JP | S 61-191862 | U | 11/1986 |
| JP | S61-191862 | U | 11/1986 |
| JP | S 62-29254 | U | 2/1987 |
| JP | S62-29254 | U | 2/1987 |
| JP | H 7-186051 | A | 7/1995 |
| JP | 2002-523250 | A | 7/2002 |

OTHER PUBLICATIONS

International Search Report, and English language translation thereof, in corresponding International Application No. PCT/JP2014/075726, dated Nov. 18, 2014, 6 pages.

Office Action, and English language translation thereof, in corresponding Japanese Application No. 2015-544875, dated Oct. 16, 2017, 10 pages.

* cited by examiner

CENTRIFUGAL PROJECTOR

This application is a 371 application of PCT/JP2014/075726 having an international filing date of Sep. 26, 2014, which claims priority to PJ2013-22680 filed Oct. 31, 2013. The entire contents of these applications are incorporated herein by reference.

TECHNICAL FIELD

The present invention relates to a centrifugal projector for projecting projection material toward a processing target.

BACKGROUND ART

Conventionally, centrifugal projectors and nozzle projectors have been known as projectors used in shot blasting, shot peening, and the like. A centrifugal projector is an apparatus which utilizes centrifugal force. A nozzle projector is an apparatus which utilizes air pressure. Nozzle projectors are efficient when the projection range is narrow in width, but are not suited to situations where the projection range is wide.

Centrifugal projectors are efficient when the projection range is wide, but were inefficient and ill-suited to situations where the projection range was narrow. In other words, in centrifugal projectors, it was difficult to concentrate the projection pattern and raise projection efficiency. Here the term "projection pattern" means the distribution of the percentage of the total amount of projection material projected at the product (processing target) hitting each position thereon. Also, "projection pattern" indicates what percent of the total projected amount is projected in a 360° range at predetermined angular positions in the circumferential direction around a rotary shaft. In the description below, the former meaning is used in explaining FIG. 13, but in other parts both the former and latter meanings are used. In addition, centrifugal projectors have better acceleration efficiency than nozzle projectors, so it is desirable to concentrate the projection pattern using a centrifugal projector to increase projection efficiency.

CITATION LIST

Patent Literature

Patent Literature 1: Japanese Patent Unexamined Publication H07-186051

SUMMARY OF THE INVENTION

Technical Problem

It is therefore an object of the present invention to provide a centrifugal projector capable of raising projection efficiency by appropriately setting a projection pattern of projection material.

Solution to Problem

The above object is achieved according to the present invention to provide a centrifugal projector for projecting projection material toward a processing target, comprising: a side plate; a plurality of blades attached to the side plate; a control cage, disposed on a radial inner side of the side plate, for releasing the projection material between the blades from an opening portion thereof; a distributor, disposed on a radial inner side of the control cage, for mixing the projection material and supplying the projection material to the control cage; a rotary shaft for rotating the side plate, the blades and the distributor; wherein the blades are formed to be pitched so that a radial outer side thereof is positioned to a rear in the rotational direction compared to a radial inner side thereof; and the control cage has two or more square or triangular windows, or has a single opening window formed as a single piece by overlapping all or a part of two or more square or triangular windows.

In the invention thus constituted, the blades are formed to be pitched so that a radial outer side thereof is positioned to a rear in the rotational direction compared to a radial inner side thereof, thus enabling projection material to be concentrated. Also, in the present invention, the control cage has two or more square or triangular windows, or has a single opening window formed as a single piece by overlapping all or a part of two or more square or triangular windows, therefore adjustment can be made to achieve projection pattern appropriate to the processing target and projection efficiency raised, so that processing variability and projection material not hitting the processing target can be reduced, thereby reducing the total amount of projected projection material.

In a preferred embodiment of the present invention, the opening window in the control cage is selected from among rectangular or parallelogram quadrilateral opening windows.

In another preferred embodiment of the present invention, the blade comprises a projection surface for projecting the projection material, and the projection surface has a first part being a radial inner part of the blade and a second part being a radial outer part of the blade; and the first part of the blade is formed to be pitched so that a radial outer side of the first part is positioned to a rear in the rotational direction compared to a radial inner side of the first part, and the second part is formed to be positioned to a front in the rotational direction of an imaginary line which extends the first part of the blade toward a radial outer side of the projector.

In still another preferred embodiment of the present invention, the blade has a blade projection portion on which the projection surface for projecting the projection material is formed, and an attachment portion with a greater thickness than the blade projection portion at both edge portions of the blade projection portion, formed as a single piece with the blade projection portion; wherein in at least the outer part of the attachment portion of the blade, the plane perpendicular to the rotary shaft direction of the blade is formed in a straight shape.

In another preferred embodiment of the present invention, the second part of the blade is formed so that an imaginary line connecting a blade rotational center and the radial outer side end portion of the second part matches a normal line.

In another preferred embodiment of the present invention, an end portion on the radial inner side of the blade projection portion of the blade is formed in a shape which tapers toward the radial inner side, and the space between each end portion on the radial inner side between each blade serves as a guide portion for directing the projection material between each rotating blade.

In another preferred embodiment of the present invention, the attachment portion of the blade has a locking portion formed by a projection from a straight shape of a plane perpendicular to the direction of the rotary shaft in the radial inner part thereof.

In another preferred embodiment of the present invention, the blade projection portion of the blade has a raised portion formed on a projection back surface opposite the projection surface, and a curved surface formed between the raised portion and the end portion on the radial inner side.

In another preferred embodiment of the present invention, an insertion opening portion is disposed on the control cage, into which the distributor can be inserted from the side opposite the rotary shaft, and a cover is disposed to cover the radial outer part of the distributor on the rotary shaft side; and the centrifugal projector further comprises a hopper, positioned on the opposite side of the rotary shaft side of the control cage, for supplying the projection material to the distributor, and a bracket, fixed between the hopper and the control cage after the distributor is disposed on the radial inner side of the control cage, the bracket blocking off a gap between the hopper and the control cage is blocked off and preventing the projection material from releasing to the outside from the gap.

In another preferred embodiment of the present invention, the control cage has two rectangular opening windows, or a single opening window in which two rectangular opening windows partially overlap and are integrated as a single piece; and the two rectangular opening windows are positionally offset in the circumferential direction and the axial direction of the control cage, and are aligned diagonally as seen from the side of the control cage.

In another preferred embodiment of the present invention, the control cage has a single opening window in which three rectangular opening windows partially overlap and are integrated as a single piece; and the opening window is positionally offset in the circumferential direction and axial direction of the control cage and, seen from the control cage side, has a diagonally aligned first rectangular part, a second rectangular part, and a parallelogram part disposed between the first rectangular part and the second rectangular part.

In another preferred embodiment of the present invention, the control cage has a single opening window in which four or more rectangular opening windows partially overlap and are integrated as a single piece; the opening window is positionally offset in the circumferential direction and axial direction of the control cage and, seen from the control cage side, has a diagonally aligned first rectangular part, a second rectangular part, and a rectangular part group made up of a plurality of rectangular parts disposed between the first rectangular part and the second rectangular part; and the rectangular parts of the rectangular part group are formed so that the length thereof in the axial direction is shorter than that of the first rectangular part or the second rectangular part.

The above object is achieved by the present invention by providing a centrifugal projector for projecting projection material toward a processing target, comprising: a side plate; a plurality of blades attached to the side plate; a control cage disposed on a radial inner side of the side plate for releasing the projection material between the blades from an opening portion thereof; a distributor, disposed on a radial inner side of the control cage, for mixing the projection material and supplying the projection material to the control cage; and a rotary shaft for rotating the side plate, the blades, and the distributor; wherein the blades are formed to be pitched so that a radial outer side thereof is positioned to a rear in the rotational direction compared to a radial inner side thereof; and the control cage has a parallelogram opening window and, in the parallelogram of the opening window, the mutually opposing sides formed in the circumferential direction are offset in the circumferential direction and the axial direction and are diagonally aligned when viewed from the side of the control cage.

In a preferred embodiment of the present invention, the blade includes a projection surface for projecting the projection material, and the projection surface has a first part being a radial inner part of the blade and a second part being a radial outer part of the blade; and the first part of the blade is formed to be pitched so that the radial outer side of the first part is positioned to a rear in a rotational direction compared to a radial inner side of the first part, and the second part of the blade is formed to be positioned to a front in the rotational direction of an imaginary line which extends the first part of the blade toward a radial outer side of the projector.

Advantageous Effects of the Invention

The present invention can concentrate the projection pattern of projection material and adjust a projection pattern appropriate to the processing target, thereby increasing projection efficiency. i.e., processing variability and projection material not hitting the processing target can be reduced, and a reduction in the total amount of projected projection material can be achieved.

BRIEF DESCRIPTION OF DRAWINGS

In FIG. 1, (a) is a front elevation view of the blade; (b) is a left side elevation view; (c) is a rear elevation view; (d) is a cross sectional view seen along line S1-S1 in (a); (e) is a plan view (top view); (f) is a bottom view (underside view).

In FIG. 3, (a) through (d) are perspective views from respectively different directions.

In FIG. 5, (a) is a front elevation cross sectional view showing a side plate unit with the blade attached; (b) is an enlarged view showing the portion of dotted line B1; (c) is a rear elevation view of the side plate unit with the blade attached.

In FIG. 5, (a) is a front elevation cross sectional view showing the side plate unit; (b) is a cross sectional view seen along line S2-S2 shown in (a).

In FIG. 8, (a) is a cross sectional view showing a rotationally driven blade, a side plate unit, and a distributor; (b) is a cross sectional view of a liner; (c) is a cross sectional view of a lid; (d) is a cross sectional view of a main unit case.

In FIG. 9, (a) through (g) are diagrams showing the behavior of projection material resulting from the rearward pitching blade according to the present invention; (h) through (n) are diagrams showing the behavior of a conventional forward-pitched blade for comparison thereto.

In FIG. 10, (a) is a front elevational view of the blade; (b) is a left side elevational view; (c) is a rear elevational view; (d) is a cross sectional view seen along line S3-S3 shown in (a); (e) is a plan view (top view); (f) is a bottom view (underside view).

In FIG. 11, (a) through (d) are perspective views from respectively different directions.

In FIG. 12, (a) is a side elevational view of a control cage with an opening window; (b) is a side elevational view of a control cage with two opening windows; (c) is a side elevational view of a control cage with one opening window in which portions of two rectangles are overlapped and integrated; (d) is a side elevational view of a control cage with a parallelogram opening window; (e) and (f) are side elevational views of a control cage with a single opening window in which parts of three or more squares are overlapped and integrated; (g) through (n) are diagrams showing the projection distribution, etc. of each control cage.

DETAILED DESCRIPTION OF THE PREFERRED EMBODIMENTS

Figure 1:
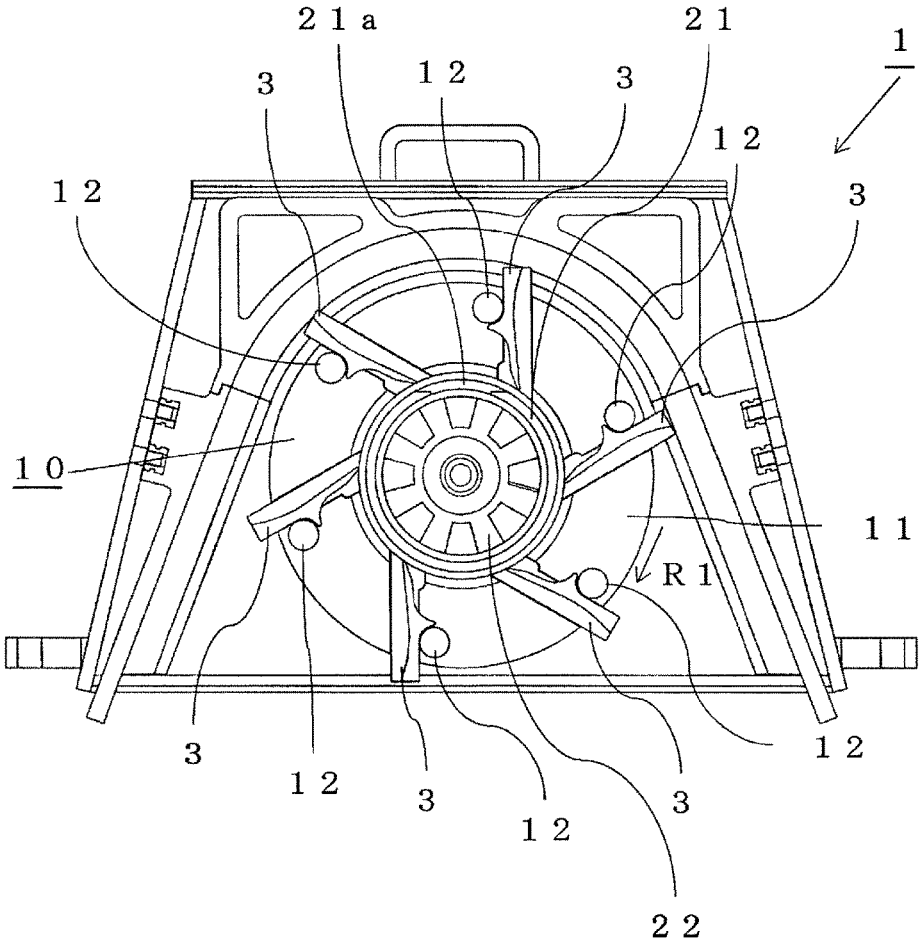
FIG. 1 is a front elevation cross sectional view showing a centrifugal projector according to an embodiment of the present invention.
Figure 2:
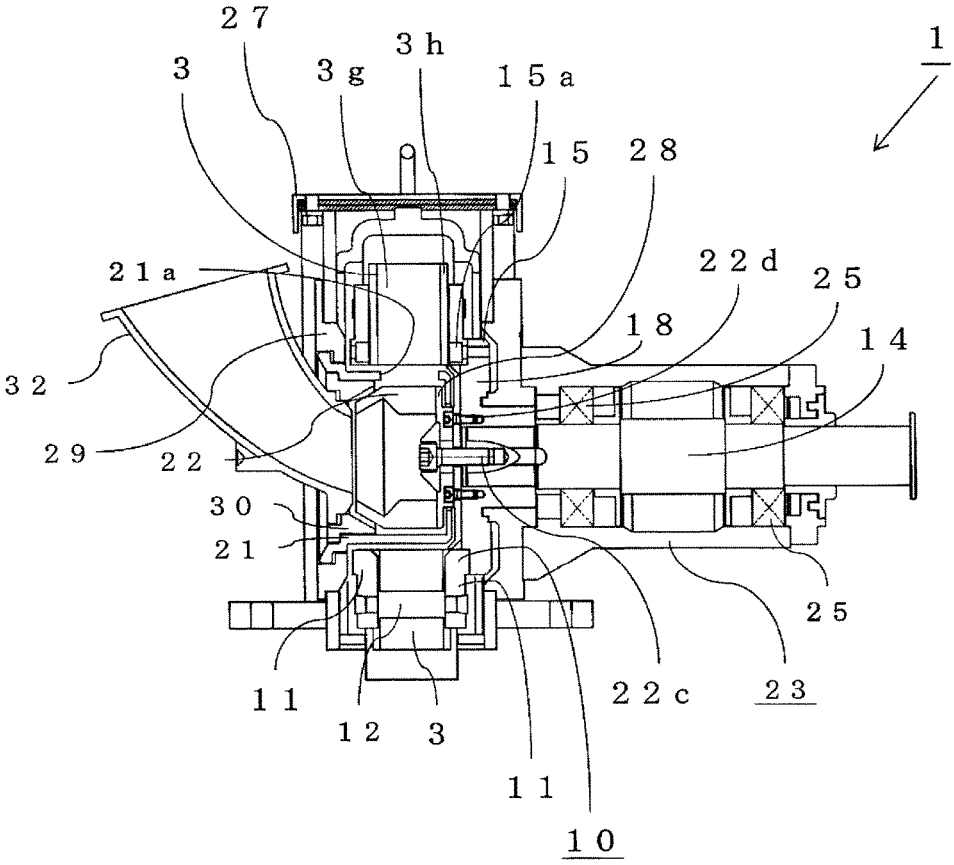
FIG. 2 is a side elevation cross sectional view of the centrifugal projector shown in FIG. 1.
Figure 3:
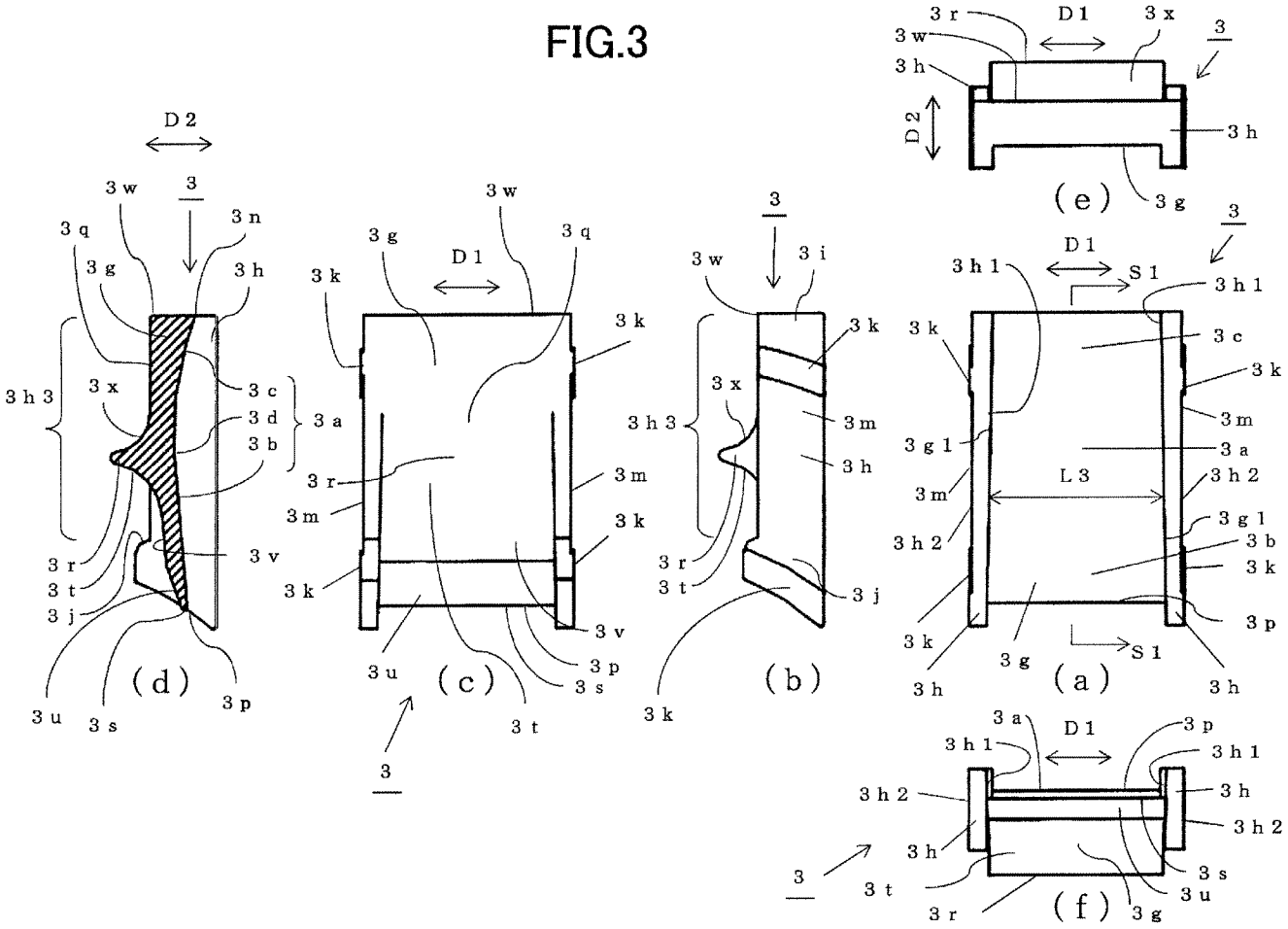
FIG. 3 is a diagram showing a blade in the centrifugal projector shown in FIG. 1.

Below, referring to drawings, a centrifugal projector according to embodiments of the present invention is explained. As shown in FIGS. 1 through 3, a centrifugal projector 1 according to an embodiment of the present invention comprises a plurality of blades 3; the blades 3 are rotated and projection material 2 ("projection material" is also referred to below as "shot") is projected by centrifugal force.

Figure 4:
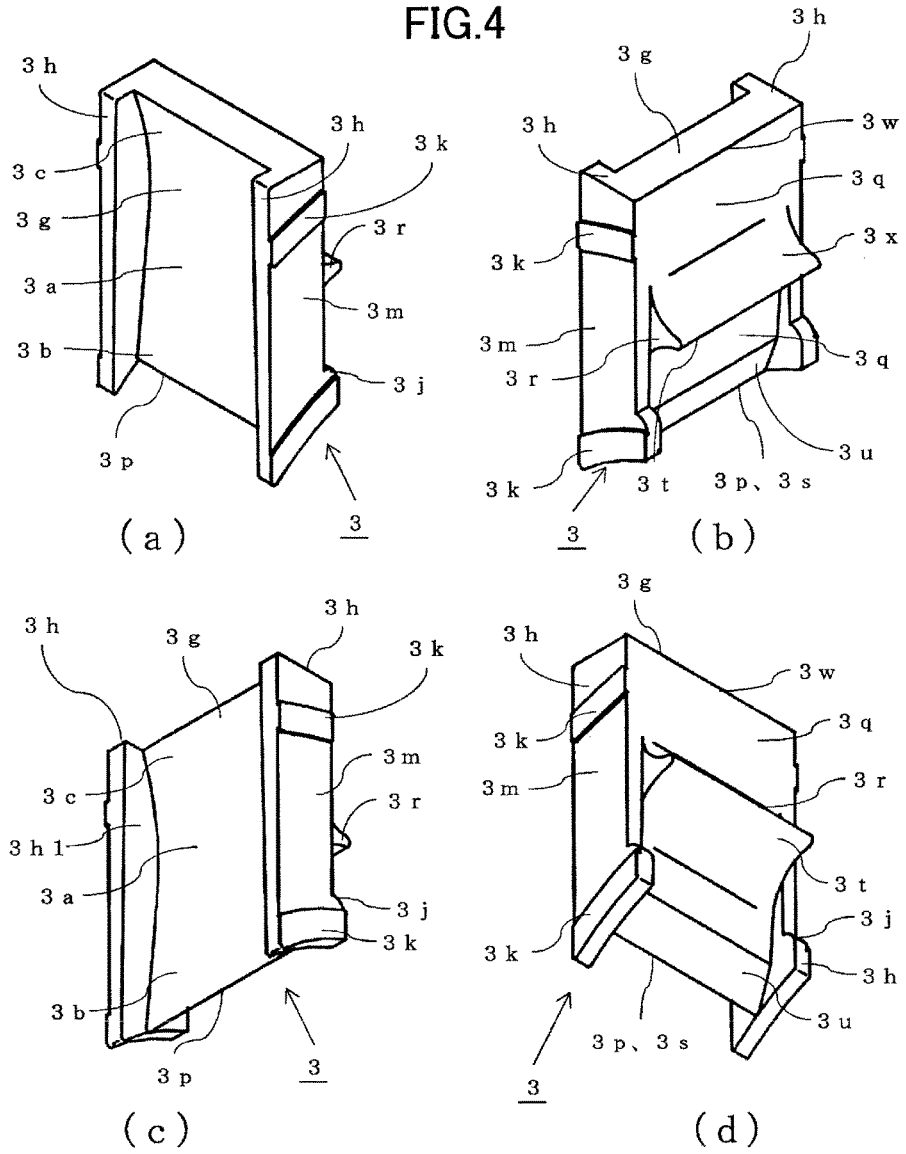
FIG. 4 is a perspective view of the blade shown in FIG. 3.
Figure 5:
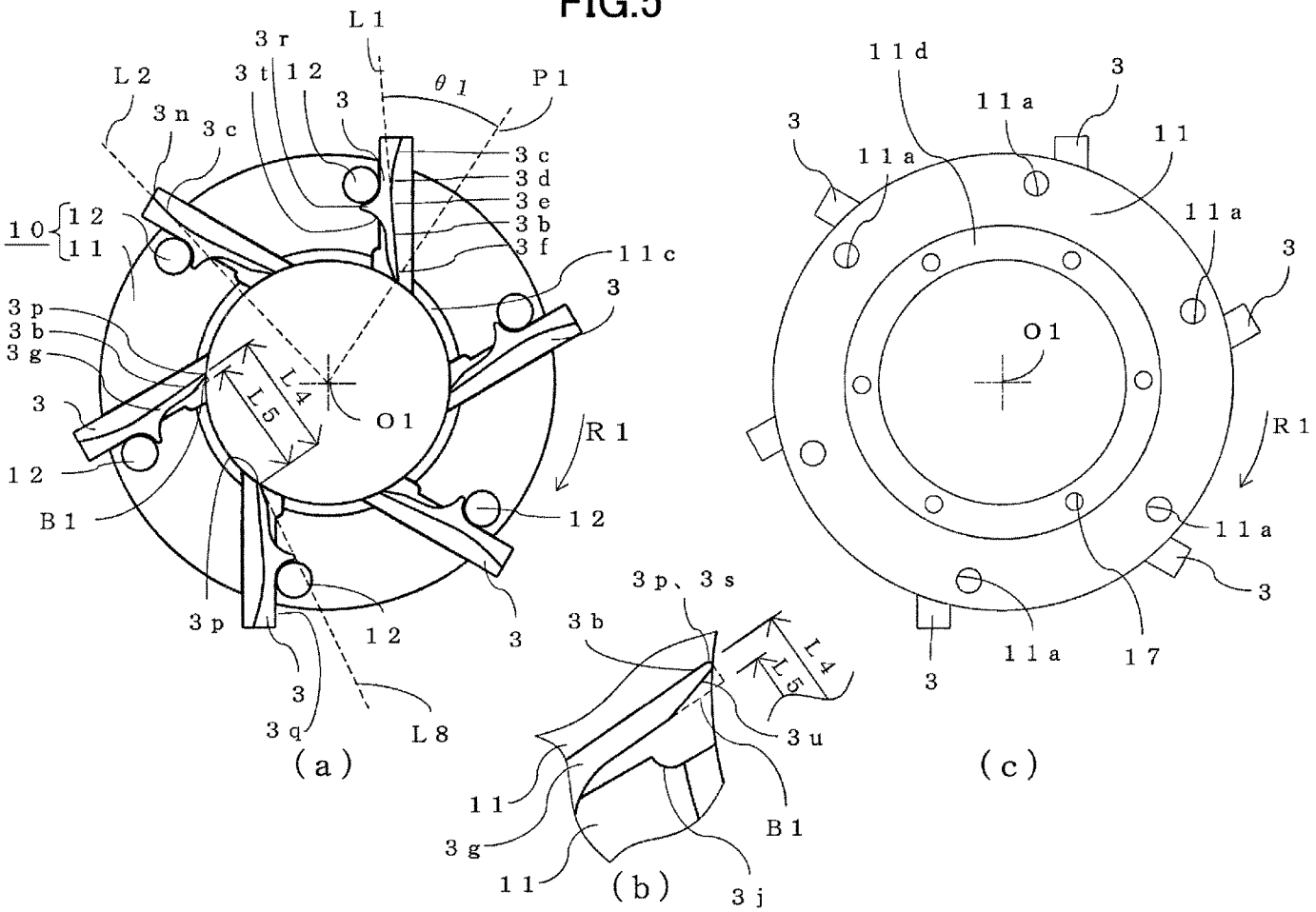
FIG. 5 is a diagram showing the blade and the side plate unit of the centrifugal projector shown in FIG. 1.

As shown in FIGS. 3 through 5, the projection surface 3*a* of each blade 3 has a first part 3*b* forming the radial inner part of the projection surface 3*a*, and a second part 3*c*, positioned radially outside the first part 3*b* and forming the outer part of the projection surface 3*a*. The second part 3*c* of the blade 3 is disposed as an integral part of the first part 3*b*, mediated by a bend or curved portion relative to the first part 3*b*. In the blade 3 explained here, the first part 3*b* and second part 3*c* are disposed through a curved portion 3*d*. The shape explained here is the shape of a cross section perpendicular to the rotary shaft of the blade 3.

As shown in FIG. 5, the outer side 3*e* of the first part 3*b* of the blade 3 is formed so that its outer side 3*e* pitches to rear side of the rotational direction R1 compared to the inner side 3*f*. The rotational direction R1 is the direction of rotation of the blade 3 and the side plate unit 10, etc. described below. In other words, the first part 3*b* of the blade 3 pitches relative to the line which includes the rotational center (the normal line). Note that the first part 3*b* of the blade 3 is formed in a straight line, but may also be a curved shape. However, a straight line shape is advantageous from the standpoint of the shot-concentrating function, and for manufacturing.

The second part 3*c* of the blade 3 is formed to be positioned more to the front side of the rotational direction R1 than the imaginary line L1, which extends the first part 3*b* outward. Note that the second part 3*c* of the blade 3 is formed with a curved shape, but may also be formed in a straight line. However, from the standpoint of the shot acceleration function described below and for manufacturing, a curved shape is advantageous. Also, in blade 3 the curved portion 3*d* is integrally formed as a single piece with the curved shape of the second part 3*c*, but blade 3 is not limited thereto.

As described above, the first part 3*b* of the blade 3 is pitched to the rear in the rotational direction, so projection material can be concentrated. For the pitch angle θ1 of the first part 3*b* of the blade 3, an angle of 30° to 50° has a favorable effect, as described below (see FIG. 5). Here "pitch angle" means the angle relative to plane P1, which includes the rotary shaft of blade 3. In the figure, O1 indicates the rotational center (rotary shaft of blade 3). Also, because the first part 3*b* of the blade 3 is formed at a pitch, projection speed of the projection material is slowed, but this can be compensated by the second part 3*c* function of accelerating projection material; i.e., a drop in projection speed of the blade 3 can be prevented, and projection speed maintained. Note that because the second part 3*c* of the blade 3 is formed to be positioned more to the rotational direction R1 front side than imaginary line L1, which extends the first part 3*b* outward, projection material can be accelerated by the second part 3*c*. Hence the blade 3, by means of the first part 3*b* and second part 3*c*, can concentrate projection pattern of the projection material without slowing the projection material speed, and projection efficiency can be increased.

Also, as shown in FIG. 3, each blade 3 has a blade projection portion 3*g* with a projection surface 3*a* for projecting projection material, and a pair of attachment portions 3*h* positioned on both edge portions of the blade projection portion 3*g*. Here, assuming the direction parallel to the axial direction of the rotary shaft of the blade 3 is first direction D1, the attachment portions 3*h* are respectively disposed on both edges of first direction D1 of the blade projection portion 3*g*. These attachment portions 3*h* are formed to have a greater thickness than the thickness of the blade projection portion 3*g* (the thickness in thickness direction of the blade projection portion 3*g* (e.g., second direction D2)), and are integrated with this blade projection portion 3*g* (see FIGS. 3(*d*) and 3(*e*). Note that the second direction D2 is perpendicular to the first direction D1 in the top view (plan view) shown in FIG. 3.

Also, the attachment portions 3*h* of the blade 3 are formed so that at least the plane of the outside part 3*i* thereof perpendicular to the direction of the rotary shaft forms a straight shape. I.e., the blade projection portion 3*g* has a curved or bent shape as described above, but the majority of the outside part of the attachment portions 3*h* (the majority of the parts other than the inside parts described below) are straight shapes without curves or bends. In FIG. 3, reference numeral 3*h*3 indicates the part formed in a straight shape on the attachment portions 3*h*.

As described above, the attachment portions 3*h* of the blade 3 are given a straight shape, facilitating the work described below of attaching to the side plate unit 10, the work of removing from the side plate unit 10, and so forth. Thus in blade 3, changing of a blade projection portion 3*g*, (blade 3) comprising a first part 3*b* and second part 3*c* for increasing projection efficiency as described above, relative to the side plate unit 10, can be easily accomplished.

Also, the blade 3 attaching portions 3*h* have a locking portion 3*j* on the radial inside part. The shape of the locking portion 3*j* in the plane perpendicular to the rotary shaft direction of the blade 3 is formed to project from the straight shape described above (see FIGS. 3(*b*) and 3(*d*)). Moreover, a plurality of contacting portions 3*k* (two each here) are disposed on the outside in the direction D1 of the pair of attachment portions 3*h*. The contacting portions 3*k* are formed to project from the outside surface 3*m* of the attachment portions 3*h*. With the blade attached to the side plate unit 10, the contacting portions 3*k* are made to contact the channel portion (guide channel portion 13) disposed on the side plate 11, and are attached at an appropriate position.

The blade 3 has a locking portion 3*j*, enabling accurate attachment to a predetermined position on the side plate unit 10 so that favorable projection performance can be achieved. Also, by bringing the contacting portions 3*k* into contact with the channel portion without the outside surface 3*m* of the attachment portions 3*h* of blade 3 directly contacting the channel portion of the side plate 11, the blade 3 can be smoothly attached when attaching it to the side plate unit 10.

The blade projection portion 3*g* and attachment portions 3*h* are formed so that the spacing L3 of the inside surfaces 3*h*1 opposing the pair of attachment portions 3*h* becomes gradually smaller toward the outside compared to the inside in the radial direction. I.e., the inside surfaces 3*h*1 opposite the pair of attachment portions 3*h* are slightly pitched. In other words, the inside surfaces 3*h*1 are mutually pitched, and are also pitched relative to the outside surfaces 3*h*2. The outside surfaces 3*h*2 on the pair of attachment portions 3*h* are essentially parallel. The outside surfaces 3*h*2 are parallel to the main surface of the side plate 11. The spacing L3 between the two edge portions 3*g*1 in the front elevation shown in FIG. 3(*a*) of the blade projection portion 3*g*, i.e. the spacing L3 in the first direction D1 of the two edge portions 3*g*1, is formed to become gradually smaller toward the outside compared to the inside in the radial direction.

Since the blade 3 thus has a blade projection portion 3*g* and attachment portions 3*h*, widening of the grouped projection material in the first direction D1 toward the radial outward direction within the centrifugal projector 1 can be prevented. I.e., the blade 3 contributes to the concentration of the projection material projection pattern, and has good compatibility with the above-described shapes of the first part 3*b* and second part 3*c*, so that the projection pattern can be concentrated by a synergistic effect. Note also that in the blade of the present invention the inside surfaces 3*h*1 and two edge portions 3*g*1 are not limited to being pitched; even if parallel, the other effects are present.

Also, the second part 3*c* of the blade 3 is formed so that an imaginary line connecting the rotational center of the blade 3 to a point close to the outside end portion of the second part 3*c* matches the normal line, so the above-described projection material accelerating function can be achieved. Here the imaginary line L2 connecting the blade 3 rotational center to the second part 3*c* outside end portion 3*n* is formed to match the normal line (see FIG. 5(*a*), etc.).

In the second part 3*c* of the blade 3 constituted as described above, the projection material projection speed can be essentially the same as the projection speed when there is a flat projection surface formed to match the normal line. I.e., the blade 3 can concentrate the projection pattern without slowing the projection speed, so that projection efficiency can be increased.

Note that in blade 3, the imaginary line L2 is formed to match the normal line to achieve essentially the same speed as the projection speed when there is a flat projection surface, but the blade 3 is not limited thereto. I.e., from the standpoint of achieving the acceleration function, the imaginary line L2 can also pitch forward in the rotational direction more than the normal line in the blade 3. In other words, the imaginary line connecting the blade 3 rotational center O1 to the radial inner side from the second part 3*c* outside end portion can be formed to match the normal line.

The end portion 3*p* of the blade projection portion 3*g* is formed in a shape which tapers toward the inside, and by enlarging the distance between the inside end portions 3*p* on each blade can function as a guide portion for increasing the amount of projection material guided between each of the rotating blades 3. I.e., the end portions 3*p* as guide portions increase the amount of projection material guided between each of the blades 3. In other words, when an end portion is not formed in a tapered shape (the case shown by the dotted line B1 in FIGS. 5 (*a*) and (*b*)), projection material colliding with that part bounces back, but when an end portion 3*p* formed in a tapered shape is adopted, the blade end portion does not interfere, and projection material enters in, increasing the amount of projection material guided between each of the blades 3.

As described below, the present inventors conducted repeated simulations and experiments, but came to understand that when the inside end portion of a blade projection portion 3*g* is formed to be thick, and the end portion on the inside of the blade projection portion 3*g* is not formed to be thick (the case shown by dotted line B1 in FIGS. 5(*a*) and (*b*)), projection material bounces back toward the center in that part (the end portion part on the thick inside). By forming the blade projection portion 3*g* inside end portion 3*p* in a tapered shape, as in the blade 3 described above, the distance L4 between the end portions 3*p* on the inside of the blade 3 can be enlarged. I.e., the distance L4 can be made large compared to the distance L5 between the end portions in the case shown by dotted line B1. The dotted line B1 indicates a comparative example relative to the tapered shape. As shown by the distance L4, the amount of projection material introduced between the rotating blades 3 can be increased using a tapered shape. In addition, bouncing back of projection material toward the center can be reduced. Hence a favorable projection pattern can be achieved.

The blade projection portion 3*g* has a raised portion 3*r* formed on a projection back surface 3*q* disposed on the opposite side to the projection surface 3*a*. The blade projection portion 3*g* has a curved surface 3*t* disposed between the raised portion 3*r* and an end portion 3*s* on the blade projection portion 3*g*. Note that here a curved surface 3*t* is formed starting from the end portion 3*s* on the projection back surface 3*q*, mediated by the taper-forming portion 3*u* and the planar portion 3*v*. The taper-forming portion 3*u* forms the above-described first part 3*b* and the above-described tapered end portion 3*p*. Also, a curved surface 3*x* is formed between the blade projection portion 3*g* raised portion 3*r* and outside end portion 3*w*. As described below, a side plate unit 10 joining member 12 can be disposed on this curved surface 3*x*. Note that the taper-forming portion 3*u* was formed in a planar shape here, but may also be formed in a curved shape, and furthermore may be formed as part of the curved surface 3*t*, without going through the planar portion 3*v*.

The above-described curved surface 3*t* on the radial inside of the blade 3 enables the projection material 2 to be smoothly guided to the projection surface 3*a* side of the next blade 3 (the next blade 3 to come around in rotation). This enables a joining member (stay bolt) 12 to be disposed on the reverse side of the raised portion 3*r* on which the curved surface 3*t* is formed, so that a return toward the center (rotational center of blade 3) of projection material which has hit the joining member (stay bolt) 12 can be prevented. Hence a centrifugal projector 1 comprising this blade 3 and side plate unit 10 can produce a favorable projection pattern.

Figure 6:
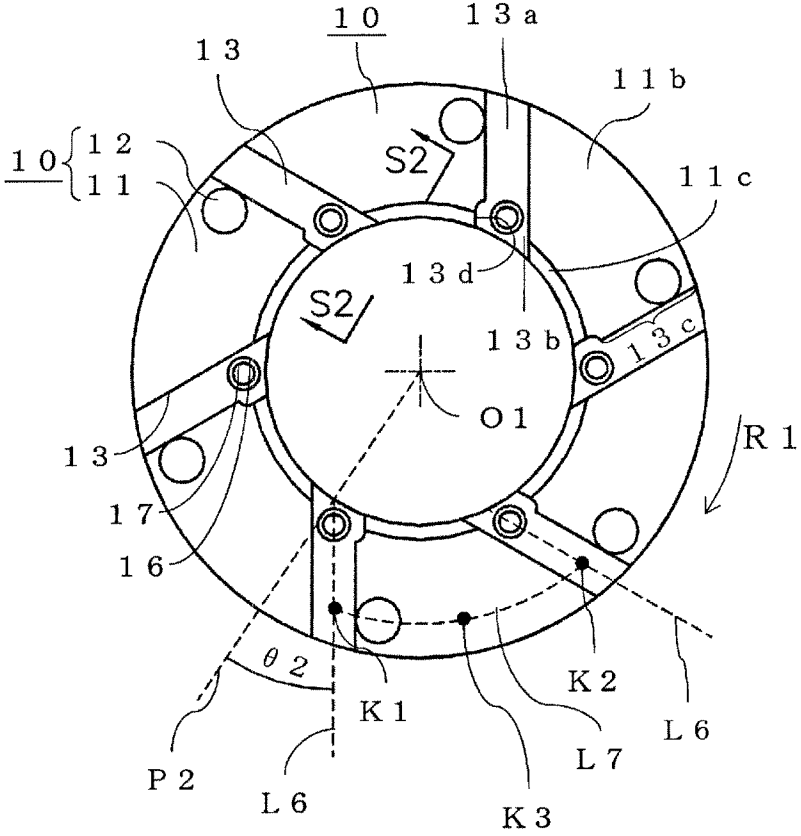
FIG. 6 is a diagram showing the side plate unit shown in FIG. 5.
Figure 6:
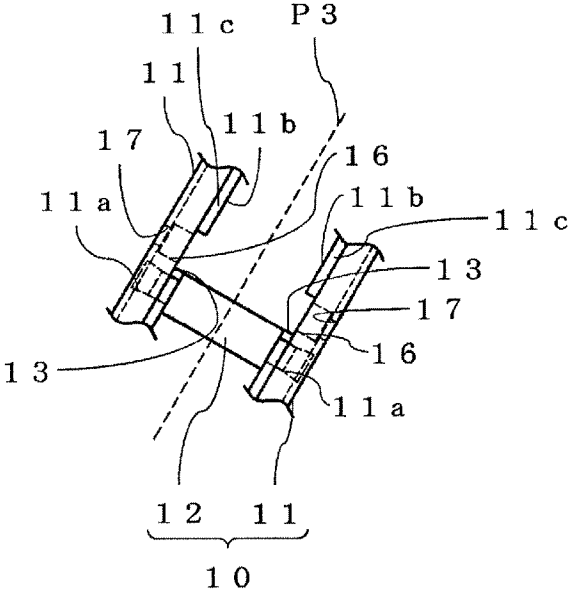

As shown in FIGS. 5 and 6, a centrifugal projector 1 according to an embodiment of the present invention comprises a side plate unit 10 for attaching the above-described plurality of blades 3. The side plate unit 10 has a pair of side plates 11 and a joining member 12 for joining this pair of side plates 11 at a predetermined separation distance. The joining member 12 is inserted into a hole 11*a* formed in the pair of side plates 11 and fixed. It is fixed, for example, by swaging or screwing. The joining member 12 is a member referred to, for example, as a stay bolt.

A guide channel portion 13 is formed in the surfaces 11*b* mutually facing the pair of side plates 11. Also, the pair of side plates 11 is a donut-shaped (ring-shaped) member, and a taper portion 11*c* is disposed on the inside of the mutually opposing surfaces 11*b*. The guide channel portion 13 is formed at a pitch so as to be positioned on the rotational direction rear side compared to the outer side 13*a* and inner side 13*b* thereof. The shape explained here is the shape in the cross section perpendicular to the rotary shaft (rotational center) of the blade 3 and the side plate unit 10. Note that the guide channel portion 13 corresponds to the attachment portions 3*h* of the blade 3; the attachment portions 3*h* of the blade 3 are slid in and inserted to attach the blade 3 to the side plate unit 10.

In such a side plate unit 10, the blades 3 can be reliably attached while demonstrating their performance in concentrating the projection pattern as described above. Blades 3 can also be easily replaced.

In the guide channel portion 13 of the side plates 11 on the side plate unit 10, at least the outside part 13*c* thereof is formed in a straight shape. Also, in the guide channel portion 13 the inside part 13*d* is formed to have a broader width than the straight shape. The inside part 13*d* of the guide channel portion 13 locks to the locking portion 3*j* on the attachment portions 3*h* of the blade 3 and regulates the position of the blade 3 (attachment portions 3*h*). The outside part 13*c* shows the part of the guide channel portion 13 formed in a straight shape. This guide channel portion 13 outside part 13*c* corresponds to the straight shaped part 3*h*3 of the attachment portions 3*h*. The imaginary center line L6 of the straight-shaped part 13*c* is tilted in the rotational rear direction (see FIG. 6). The pitch angle θ2 is set at an angle close to the blade tilt angle, for which an angle of 30° to 50° is favorably effective. Here "pitch angle" means the angle relative to plane P2, which includes the rotary shaft of blade 3.

Since the guide outside part 13*c* of the channel portion 13 on the side plates 11 is given a straight shape, blades 3 can be easily replaced. i.e., the blades 3, which implement the functions of concentrating and accelerating projection material, can be appropriately attached. In other words, while the first part 3*b* and second part 3*c* are formed on the projection surface 3*a* of the blade projection portion 3*g* as described above, the attachment portions 3*h* and guide channel portion 13 have a straight shape, therefore the blades 3 can be attached and removed in a simple and smooth manner.

Also, the locking portion 3*j* of the attachment portions 3*h* of the blade 3 can lock to the inside part 13*d* of the guide channel portion 13 on the side plates 11, therefore the blades 3 can be fixed at an appropriate position.

The joining members 12 on the side plate unit 10 are provided in the same number as the number of blades 3. Each joining member 12 is positioned between the blades 3. In addition, joining members 12 are disposed at positions closer to the projection back surface 3*q* than the midway position between the blade 3 projection surface 3*a* and the projection back surface 3*q* on adjacent blades 3. Note that to obtain the midway position, a calculation is made of an imaginary arc L7 passing through the center position of the joining member 12, and of intersections K1, K2 with the above-described imaginary line L6, centered on O1 (see FIG. 6). It is sufficient to be on the imaginary arc L7, and to designate the point K3 positioned midway between these intersections K1, K2 as the "midway position." In such cases, the joining member 12 is positioned on the projection back surface 3*q* side of the midway position K3. The "midway position" is not limited to this; it is also possible to calculate the intersection between the arc L7 and the projection surface 3*a* and the intersection between the arc L7 and the projection back surface 3*q* and use a point positioned on the arc L7 and between these intersections.

As shown in FIG. 5, in a cross section within a plane perpendicular to the direction of the rotary shaft, the imaginary line connecting from the tip of the end portion 3*p* inside the blade projection portion 3*g* so as to contact the raised portion 3*r* formed on the projection back surface of the blade projection portion 3*g* (contact close to the peak of the raised portion 3*r*) is deemed to be imaginary line L8. Relative to this imaginary line L8, a favorable projection pattern can be formed by disposing the joining member 12 in a position where the joining member 12 is close to the blade 3 projection back surface 3*q*, so that at least a part of the cross section of the joining member 12 is positioned on the projection back surface 3*q* side of the blade 3. Here, furthermore, the joining member 12 is disposed in a position close to the projection back surface 3*q* of the blade 3 so that, relative to this imaginary line L8, the surface area of the cross section in the part on the side of the projection back surface 3*q* of the blade 3 is half or more of the cross section of the joining member 12, therefore a favorable projection pattern can be formed.

The side plate unit 10 thus constituted prevents projection material which has collided with the joining member (stay bolt) 12 from returning to the center side. Hence a centrifugal projector 1 comprising this blade 3 and the side plate unit 10 can produce a favorable projection pattern.

The number of the above-described blades 3 is six. This means that compared to cases in which 8 or 12 units are provided, the distance between the end portions on the inside between each blade can be increased, and bouncing back of projection material toward the center at the end portions of each blade can be reduced; i.e., the projection pattern can be improved. This is also just right when considering the same number of joining members (stay bolts). In other words, the same number of joining members 12 were provided as for the blades 3 described above, but if the number of joining members 12 becomes excessive, the potential increases for projection material which has bounced back at the joining members to return to the center side. On the other hand if six blades and joining members are provided, the effect of the joining members can be reduced and a favorable projection pattern achieved. If the number is reduced too much, for example to four, blade friction becomes a problem, and the frequency of blade replacement increases, along with maintenance person hours. Increases in the time difference in projection material (projection material supplied from the control cage opening window 21*a* described below) supplied to each blade leads to the problem of increased blade size in the radial direction, and increased blade weight. In light of the above, 6 to 8 blades is an appropriate number, and 6 is the optimal number in the present invention.

Figure 7:
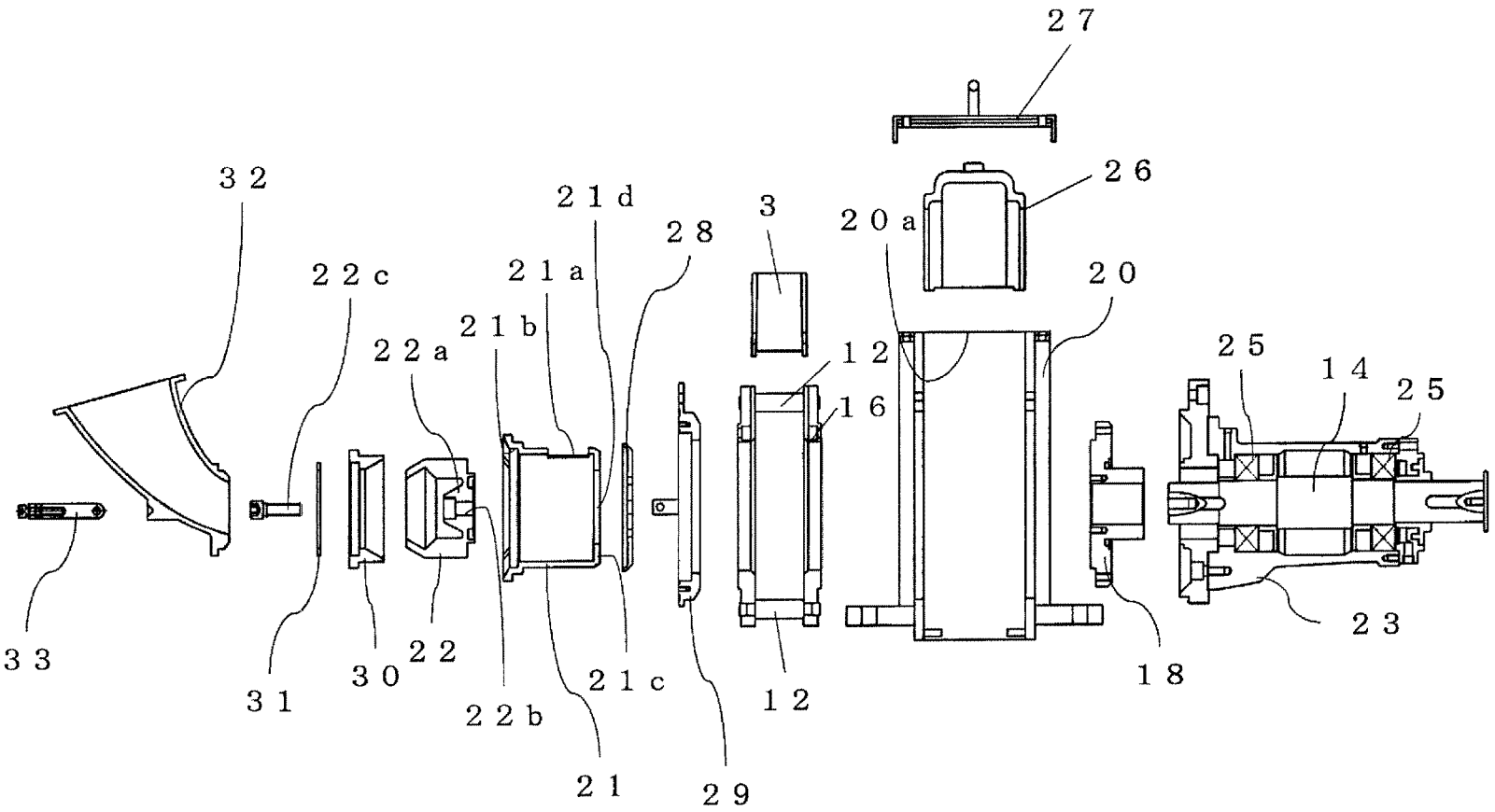
FIG. 7 is a component exploded view showing the separate major parts of the centrifugal projector shown in FIG. 2.
Figure 8:
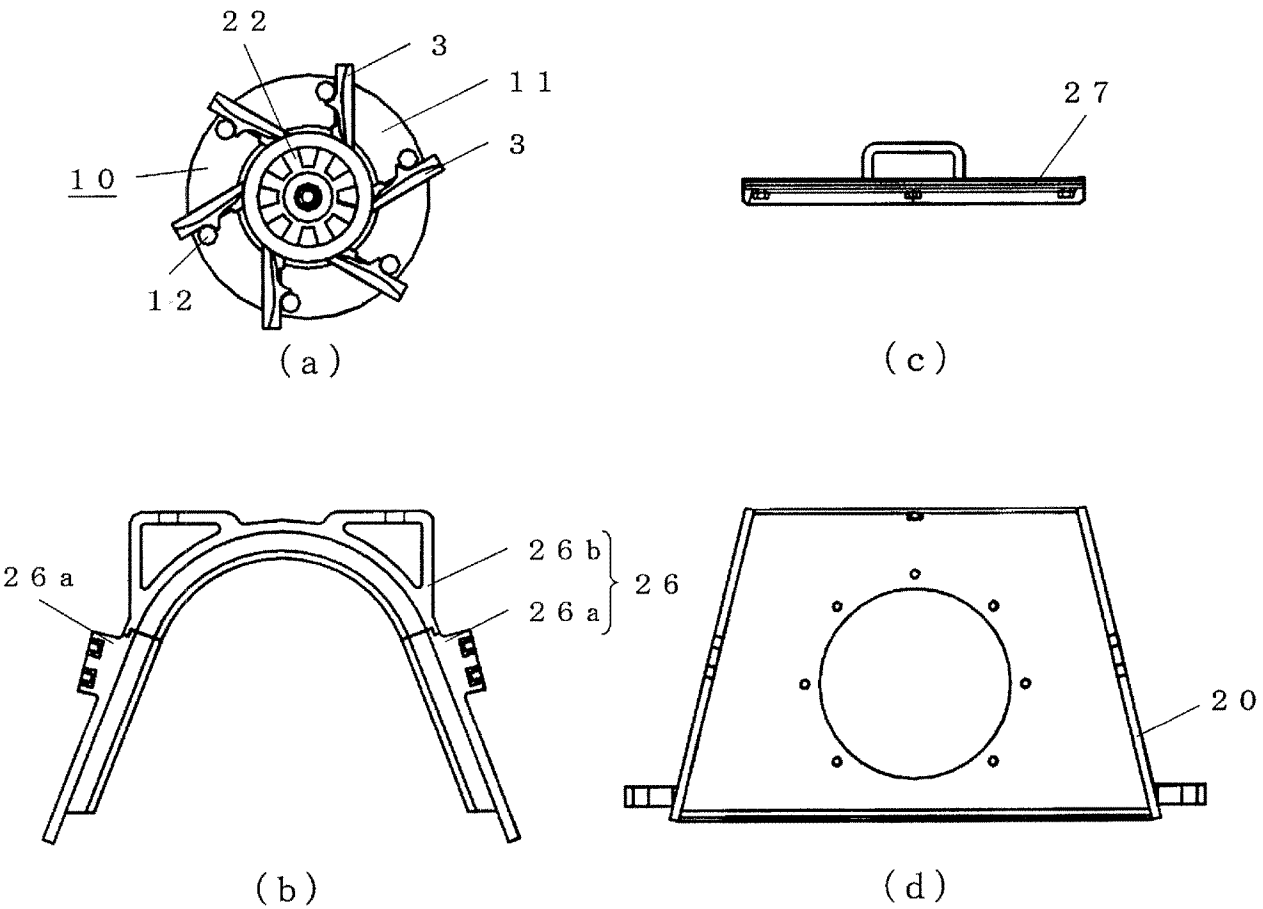
FIG. 8 is a diagram showing the major parts, partially separated, of the centrifugal projector shown in FIG. 1.

As shown in FIG. 6, a concave portion 16 for attaching a bolt 15 to fix the side plate unit 10 to the rotary drive side is provided on the guide channel portion 13 of the side plates 11. Rotary drive side here means the hub 18 fixed to the rotary shaft 14 rotated in the rotary drive section (see FIGS. 2 and 7). An insertion hole 17 into which the bolt 15 is inserted is formed in this concave portion 16. On the pair of side plates 11, a thick portion 11*d* is formed on the inside perimeter portion of the surface (outside surface) on the opposite side of mutually opposing surfaces, and the insertion hole 17 is positioned on the thick portion 11*d*.

The concave portion 16 and insertion hole 17 are provided in the side plates 11, therefore fixing to and removal from the rotary shaft 14 side (hub 18) of the side plate unit 10 can be performed from the side plate unit 10, i.e. in the main unit case 20. By providing a concave portion 16 for attaching a bolt 15 to the guide channel portion 13, the bolt 15 head portions 15*a* are hidden by the attachment portions 3*h* of the blade 3 after attachment of the blades 3 to the guide channel portion 13 of the side plate unit 10. As a result, the bolt 15 head portion 15*a* is not abraded. Also, fixing to and removal from the side plate unit 10 rotary driver side (rotary shaft 14, hub 18) can be performed from the side plate unit 10 side. Attachment of the side plate unit 10 to the hub 18, which is on the rotary drive side, was conventionally frequently done from the hub 18 (rotary shaft side), which was inconvenient. Here, because fixing of the side plate unit 10 rotary drive side can be performed from the side plate unit 10 side, attaching work is eased and convenience improved.

The pair of side plates 11 is formed to be plane-symmetrical relative to the imaginary plane P3 perpendicular to the joining member 12 (see FIG. 6(*b*)). I.e., the above-described concave portion 16 and insertion hole 17 for attaching the bolt 15 are placed on both of the pair of side plates 11. By changing the side of attachment to the pair of side plates 11 hub 18, the orientation of the guide channel portion 13 changes to the opposite side, and the orientation of the blades 3 changes to the opposite side. This enables reverse rotation of the rotary shaft 14 and the blade 3. By this means, the same product (processing target) can be supplied to each user desiring clockwise and counterclockwise rotation; i.e., general applicability can be improved.

Next, referring to FIGS. 1 through 8, the configuration of centrifugal projector 1 is explained more specifically. The centrifugal projector 1 comprises a control cage 21 and a distributor 22. In addition, the centrifugal projector 1 comprises a main unit case 20, hub unit 23, hub 18, liner 26, lid 27, center plate 28, front cover 29, bracket 30, seal 31, hopper 32, hopper hold down 33, and the like.

The control cage 21 has the function of controlling the projection direction and distribution shape of the projection material. The side plates 11 which constitute the side plate unit 10 have a donut-shaped (ring-shaped) cross section. The control cage 21 is disposed and fixed on the inside of the side plates 11 (inside the inside diameter of the ring-shape). The opening window 21*a* is placed on the control cage 21. Projection material is released toward the blades from this opening window 21*a*.

The bracket 30 functions as a supplementary bracket for supplementing the control cage 21. I.e., on the opposite side to its rotary shaft (the hopper 32 side), the control cage 21 has an insertion opening portion 21*b* into which the distributor 22 can be inserted from the opposite side (the hopper 32) to that rotary shaft. Also, on its rotary shaft side the control cage 21 has a cover portion 21*c* for covering the outside part on the rotary shaft side and in the radial direction of the distributor 22. Note that an opening 21*d* is provided on the inside of the cover portion 21*c*, large enough to enable the attachment of a bolt 22*c* for fixing the distributor 22 to the center plate 28 and hub 18. After the distributor 22 is attached, by fixing the bracket 30, along with the hopper 32, to the control cage 21 side, the gap between the control cage 21 and the hopper 32 can be blocked to prevent projection material 2 from being released to the outside from this gap.

As discussed above, the control cage 21 and bracket 30 can be inserted from the hopper 32 side (the opposite side to the rotary shaft 14) when the distributor 22 is disposed inside the control cage 21. By so doing, a cover portion 21*c* covering the outside part on the rotary shaft side and in the radial direction of the distributor 22 can be placed on the control cage 21. This cover portion 21*c* enables the gap between the distributor 22 and the control cage 21 on the rotary shaft side to be reduced, which allows leakage of projection material from this gap to be minimized, and projection material projection efficiency to be improved. The control cage 21 and bracket 30 greatly reduce work time when changing or maintaining the distributor 22.

The distributor 22 accelerates projection material supplied from the hopper 32 while stirring it, then supplies it to the blades 3 through the opening window (opening portion) 21*a* in the control cage 21. Openings are placed, for example, at essentially equal spacing in the circumferential direction on the distributor 22. The distributor 22 is rotatable inside the control cage 21.

Inside the distributor 22, an essentially triangular pyramid projection portion 22*a* forming a hole portion 22*b* for the attaching bolt 22*c* is formed on the interior of the distributor 22. A key channel is formed in the rotary shaft 14 and hub 18, which are linked so that they can rotate together using a key, not shown. A bolt (joining member) 22*d* is joined to the center plate 28 and the hub 18. The bolt (joining member) 22*c* joins the rotary shaft 14 and the distributor 22, gripping the center plate 28. The hub 18 has the function of transferring rotary force transferred from the rotary shaft 14 to the side plate unit 10 and the blades 3. The center plate 28 is a plate member with the function of blocking the opening on the rotary shaft side of the side plate unit 10, preventing leakage of projection material. The positional relationship in the radial direction is that the control cage 21 is disposed on the inside of the side plate unit 10, and the distributor 22 is disposed on the inside of the control cage 21. The presence of a member for transferring rotational force as described above results in the blades 3, side plate unit 10, hub 18, center plate 28, and distributor 22 being rotationally driven by the rotary shaft 14.

The hub unit 23 has a rotary shaft 14. This rotary shaft 14 is held by two bearings 25. A pulley for belt transferring drive force from a motor and a hub 18 for transferring to the side plate unit 10 are attached to the rotary shaft 14. The hub 18 has the function of joining the rotary shaft 14 and the side plates 11 (side plate unit 10).

The side plate unit 10 allows for the attachment of blades 3, and is rotated together with the blades 3. Blades 3 rotate while being attached to the side plate unit 10, thereby projecting the projection material (shot). As described above, the centrifugal projector 1 has blades 3 with a concentrating function (the function of concentrating the projection material 2), side plates 11 to/from which blades 3 can be attached and removed, control cage 21, and distributor 22, so that a projection pattern can be concentrated, and projection efficiency over a narrow projection range can be improved. Using the centrifugal projector 1, projection material is concentrated on blades 3 with a concentrating function, and the concentrated projection material is released. At this point the projection material concentrated by the first part 3*b* is released from the second part 3*c*, which has a shot accelerating function, thereby improving projection efficiency is improved.

The purpose of the main unit case 20 is to assemble each constituent part. The liner 26 protects the main unit case 20 from projection material. A side liner 26*a* and a top liner 26*b* are used in the liner 26. The lid 27 opens and closes the upper opening 20*a* on the main unit case. The center plate 28 functions to prevent blades 3 from dropping and to protect the shaft end portion of the rotary shaft 14. The front cover 29 can be removed for maintenance.

The interior of the bracket 30 has a tapered opening, and projection material (shot) supplied from the hopper 32 is supplied into the distributor 22. The seal 31 prevents projection material from leaking out from the gap between the hopper 32 and the bracket 30. The hopper 32 supplies projection material into the centrifugal projector 1. The hopper hold down 33 fixes the centrifugal projector 1 main body to the hopper 32. An abrasion-resistant casting may be used for the hopper 32, in which case wear of the interior surface caused by projection material can be reduced, along with the frequency of replacements. It is permissible to use a material with lower abrasion characteristics than abrasion-resistant castings, but to prevent degradation of the flow of projection material due to abrasion of the inside surface requires replacement of parts at the appropriate timing.

Next the centrifugal projector 1 attachment procedure is explained. The procedure for removal is the reverse of the above. The hub unit 23 is fixed to the main unit case 20 with a bolt or the like. To prevent abrasion by the projection material, a liner 26 is attached around the circumference of the rotary shaft 14 on the input surface of the main unit case.

The hub 18 is inserted into the rotary shaft 14 of the hub unit 23. The side plates 11 are fixed to the hub 18 from the inside surface of the centrifugal projector 1 by the bolt 15. Here the pair of side plates 11, separated by a certain distance, are fixed by the joining member 12. I.e., with the pair of side plates 11 joined by the joining member 12, the side plate unit 10 is fixed to the hub 18.

The blades 3 are inserted from the inside toward the outside of the guide channel portion 13 on the pair of side plates 11, and are fixed by the center plate 28. Since centrifugal force acts in outward direction, a constitution in which blades are not fixed by the center plate 28 is also acceptable. When so doing, the locking portion 3*j* of the blades 3 locks to the inside part 13*d* of the guide channel portion 13, so the position of the blades 3 is appropriately placed.

The front cover 29 is fixed to the main unit case 20 with a bolt or the like. The center plate 28 is fixed by the bolt 15 to the hub 18, holding the inside diameter part of the blades 3 on its outer circumferential portion. After the control cage 21 is inserted into the pair of side plates 11, the distributor 22 is inserted therein, and the distributor 22 is fixed to the rotary shaft 14 by the bolt 22*c*.

On the control cage 21, the position of the opening window 21*a* is adjusted so projection material can be projected in the appropriate direction; the bracket 30, seal 31, and hopper 32 are attached in that order, and the control cage 21 is fixed while being held down by the hopper hold down 33.

The plurality of blades 3 are attached to the pair of side plates 11, separated by a gap, on the outside of the control cage 21. The distributor 22 is placed on the inside of the control cage 21, separated by a gap. The blades 3 and side plates 11, and the distributor 22, can be rotated about the same rotational center O1. The first part 3*b* of the blades 3 can also function as shot receiving portions. The second part 3*c* thereof also functions as a shot acceleration portion.

Next it is explained a projection method using a centrifugal projector 1, and the motion of projection material projected by the centrifugal projector 1, according to the above-described embodiment of the present invention. The projection method using the centrifugal projector 1 has a step for scattered shot release from the control cage 21, a step for concentrating shot on the blades 3, and a step for releasing shot from the blades 3. I.e., in the scatter release step, projection material is scatter-released from the opening window 21*a* on the control cage 21 toward the blades 3. In the concentrating step, the scatter-released projection material is concentrated on the blades 3. In the release step the projection material concentrated on the blades is released from the blades 3.

"Scatter release" here means that projection material is spread apart, scattered, and released. This means projection material is not released as an aggregated group, but a plurality of pieces are released in a spread-apart manner. "Concentration of projection material" refers to raising the density of the plurality of pieces of projection material released in a spread-apart manner onto the blades 3. "Release from the blades 3" refers to the release from the increased density projection material group from the blades 3 to the outside of the centrifugal projector 1. The blades 3 have the function of accelerating projection material received from the control cage by centrifugal force.

The motion of projection material together with the operation of the centrifugal projector 1 parts is explained. First, the distributor 22, blades 3, side plate unit 10, and so forth are rotated. Next, projection material 2 is supplied into the distributor 22. The supplied projection material 2 is then supplied by centrifugal force from the opening in the rated distributor 22 into the gap between the control cage 21 and the distributor 22. The supplied projection material 2 moves through this gap in the direction of rotation. The projection material 2 moving through the gap flies outward from the opening window 21*a* in the control cage 21. The projection material 2 flying out from the opening window 21*a* is accelerated and concentrated by the first part 3*b* functioning as shot receiving portion; it is then further accelerated by the second part 3*c* functioning as shot accelerating portion, and is projected by centrifugal force from the outside of the blades 3.

Here it is explained the advantages of the blades 3 in the centrifugal projector 1 according to the above-described embodiment of the present invention. In the conventional blades we compare with the blades of the embodiment, the first part is not pitched with respect to a plane P1, and no second part is provided. i.e., conventional blades have a projection surface with an essentially flat surface (the plane P1 shown in FIG. 5(*a*)), and the normal line and rotary shaft are included in this surface. With conventional blades, projection material leaving the opening window in the control cage at different times is projected from the blades with that time difference intact. This results in a broad projection pattern.

Figure 9:
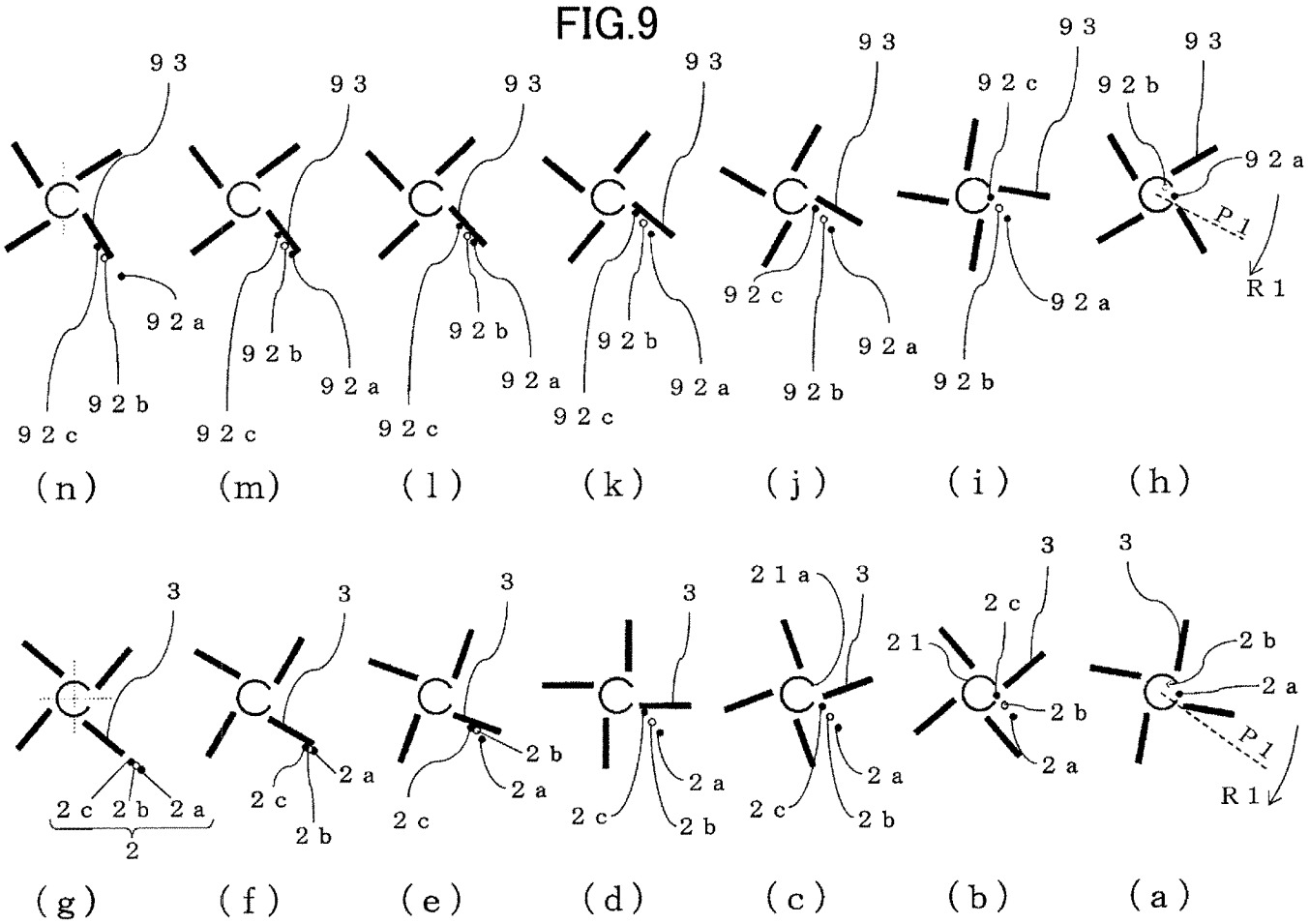
FIG. 9 is a diagram for explaining the advantages of pitching the first part of the blade rearward.

In contrast, the blades 3 on the above-described centrifugal projector 1 have the following advantages because the first part 3*b* is inclined rearward relative to the plane P1. These advantages are explained along with the behavior of the projection material 2 using FIGS. 9(*a*)-(*g*). In FIGS. 9(*a*)-(*g*), in order to explain the behavior thereof in an easily understood manner, a part of the projection material 2 released in great volume is selected for the projection material 2*a*-2*c*, (the same is true of the projection material 92*a*-92*c* shown in FIGS. 9(*h*)-(*n*)). In the rearward pitching blades 3 described above, the last projection material 2*c* to have left the opening window 21*a* first lands on the blades 3, then advances to the outer circumference of the blade as it is being accelerated. When projection material 2*b* which has left the opening window 21*a* midway between the end and start lands on the blades 3, the projection material 2*c* which first landed on the blades 3 is present in close proximity to it. These final and midway projection materials 2*c*, 2*b* are accelerated, so when projection material 2*a* which has left the opening window 21*a* at the beginning lands on the blades, these final and midway projection materials 2*c*, 2*b* are present in close proximity to it. Hence when the above-described blades 3 are used, the projection pattern of the projection material supplied at different times from the opening window 21*a* on the control cage 21 can be narrowed by projection from the blade tips with essentially no time difference.

For comparison with the rearward pitching blade explained in the above-described FIG. 9(*a*) through (*g*) we explain, referring to FIG. 9(*h*)-(*n*), the behavior of the projection material 92 when blades 93 (comparative example) are pitched forward relative to the plane P1, opposite the direction of the blades 3. In the forward-pitched blades 93, the dispersion area for supplied projection material, which joins together the projection material 92*a* which first left from the opening window with the projection material 92*c* which last left the opening window, is essentially parallel to the blades 93. The projection material 92*a* which first left from the opening window, the projection material 92*b* which left midway between the beginning and end, and the projection material 92*c* which last left the opening window therefore all land on the forward-pitched blades 93 at essentially the same time, and the projection pattern widens by the amount of time during which the projection material 92*b* moves over the forward-pitched blades 93 to the position of the projection material 92*a*.

The constitution and advantages of the above-described first part 3*b* of the blades 3 were discovered by the present inventors by careful examination of the behavior of projection material supplied to blades, and of repeated simulations and experimentation. The present inventors also carefully examined the behavior of blades pitched forward relative to the plane P1, and comparing these elements determined the constitution described above. In addition, with respect to the advantages of the second part 3*c* described next, the appropriate range of the pitch angle θ1, and the above-described number of blades 3, the inventors succeeded through repeated simulations and experiments in finding an advantageous and feasible solution and were able to make something which can be mass produced and which is feasible in light of the fact that blades are consumable parts.

Next the advantages of the second part 3*c* are explained in further detail. As described above, when the advantages of the first part 3*b* are considered, the blade 3 can be made practical using only rear-pitched surfaces for concentrating the projection pattern. However, projection speed relative to rpm declines to the degree the blades are pitched rearwardly, therefore to increase projection speed requires raising the rpm. Increasing the rpm causes problems such as a rise in power consumption or a rise in noise when projection material is not being projected. By measures such as placement of a bent portion on the outside of the first part 3*b* serving as a shot receiving portion, it was able to concentrate the projection pattern without changing projection power efficiency by adopting a constitution using blades 3 (accurately stated, the blades 3 explained in FIGS. 3 and 4) wherein the second part 3*c*, which in substance performs the blade projection, is pitched further forward than the first part 3*b*, which is the receiving portion. This enabled the projection speed relative to rpm to be increased using the second part 3*c* of the blades 3.

The pitch angle θ1 on the first part 3*b* of the blades 3 is explained in further detail. As described above, 30°-50° is favorable for the rearward pitch angle of for the first part 3*b*, i.e. the pitch angle θ1 relative to plane P1. As described above, on the blades 3 the projection pattern is concentrated by gathering continuously supplied projection material in the first part 3*b*, but if the angle is less than 30°, the time difference in riding on the blades is shortened, and the degree of distribution concentration is reduced. Above 50°, the time difference becomes too large, and projection material which has landed on the blades close to the blade stem passes projection material received at the tip portion of the blades and is projected first, reducing effectiveness. Since the length of the first part 3*b* increases as the blades are pitched rearward, blades become heavier, increasing parts cost, reducing workability, and so forth. An appropriate range of angles is determined based on the reasons above.

It happens that the above-described projection surface 3*a* is also the surface on which the earlier explained projection material 2 moves. The projection back surface 3*q* is also opposite the surface on which the projection material 2 moves. The blade projection portion 3*g* may be said to be at least in part sandwiched between this projection surface 3*a* and the projection back surface 3*q*. The attachment portions 3*h* are members for attaching and fixing the blades 3 to the pair of side plates 11. The shape of the attachment portions 3*h* and the guide channel portion 13 is not limited to that described above, but should be constituted so that the blades 3 are mechanically attachable and detachable from the side plate unit 10. It is desirable for the combination of the side plate unit 10 and blades 3 to be fixed by centrifugal force as described above, for example.

In the centrifugal projector 1 and blades 3 used for same, constituted as described above, the projection material projection pattern can be concentrated, and projection efficiency can be increased in a narrow projection range. I.e., the projection pattern is concentrated, therefore the number of shot pieces not hitting the product can be reduced and projection efficiency improved when the processing target is small.

Thus by careful investigation of the overall motion of projection material supplied to each blade, it has been possible to identify for the first time the optimal constitution for the centrifugal projector 1 and blades 3. Previous efforts sought to study the motion of projection material one ball at a time to increase acceleration characteristics. This constitution of the centrifugal projector enables concentration of the motion of all projection material to concentrate the projection pattern. High efficiency projection is thus enabled.

In addition, the above-described side plate unit 10 and centrifugal projector 1 in which it is used can concentrate the projection material projection pattern so that projection efficiency relative to a narrow projection range can be increased, and the following effects obtained. I.e., blades 3 with the above-described types of effect can be easily and securely attached and replaced.

Note that the blades used in a centrifugal projector 1 according to an embodiment of the invention are not limited to the blades 3 shown in the above-described FIGS. 3 and 4. It is sufficient that they be constituted to have at least one of the above-described effects. Specifically, the blades 7 shown in FIGS. 10 and 11 may also be used as blades for the centrifugal projector 1. Note that compared to the above-described blades 3, the blades 7 have essentially the same constitution and effect as the blades 3, other than not having the raised portion 3*r* and raised portion 3*r*. Parts with the same constitution, function, and effect are identified with the same names and similar reference numerals (reference numerals following "3" and "7" are shared in common), and a detailed explanation thereof is omitted.

Figure 10:
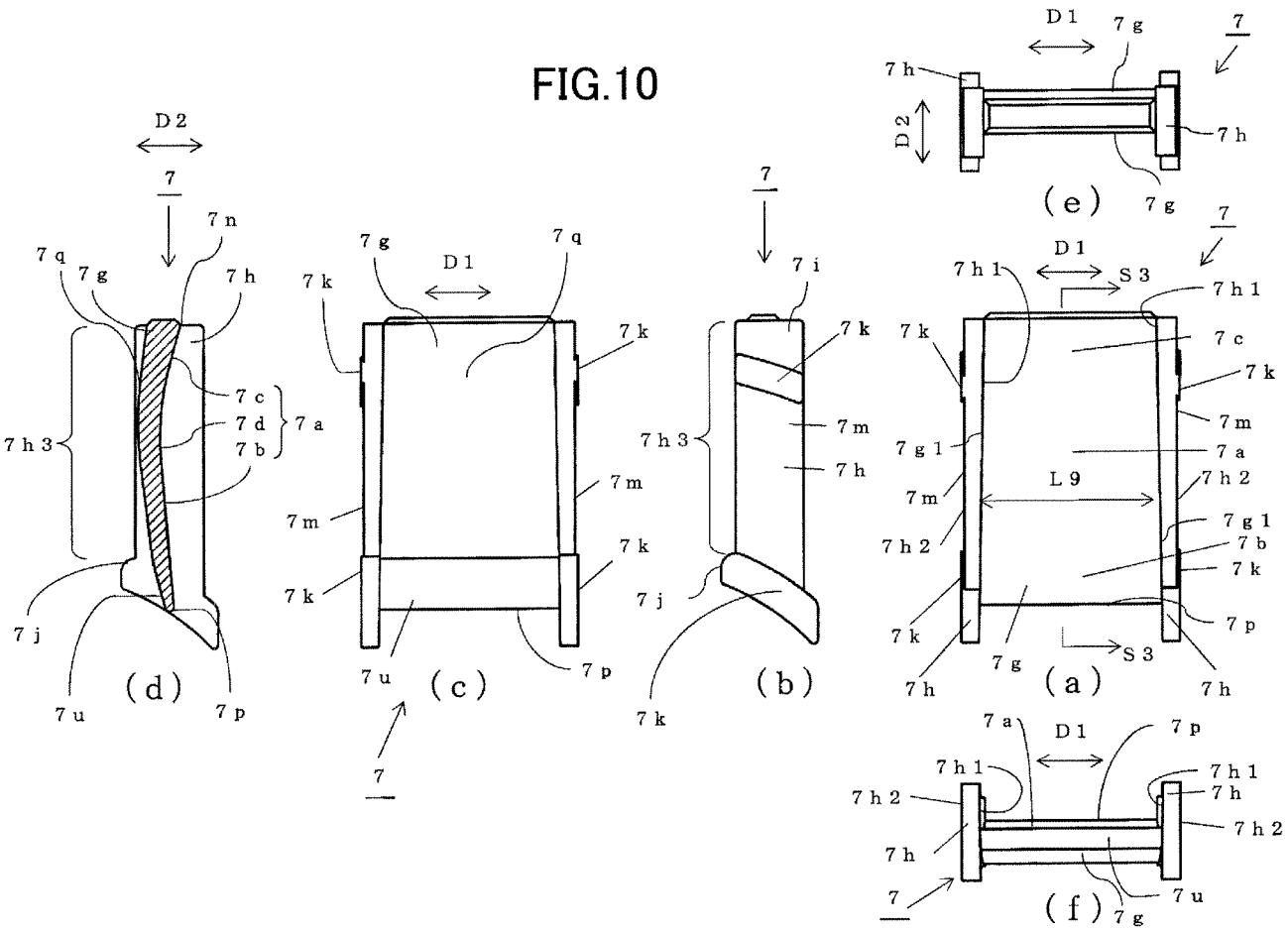
FIG. 10 is a diagram showing another example of a blade which can be used in a centrifugal projector according to an embodiment of the present invention.
Figure 11:
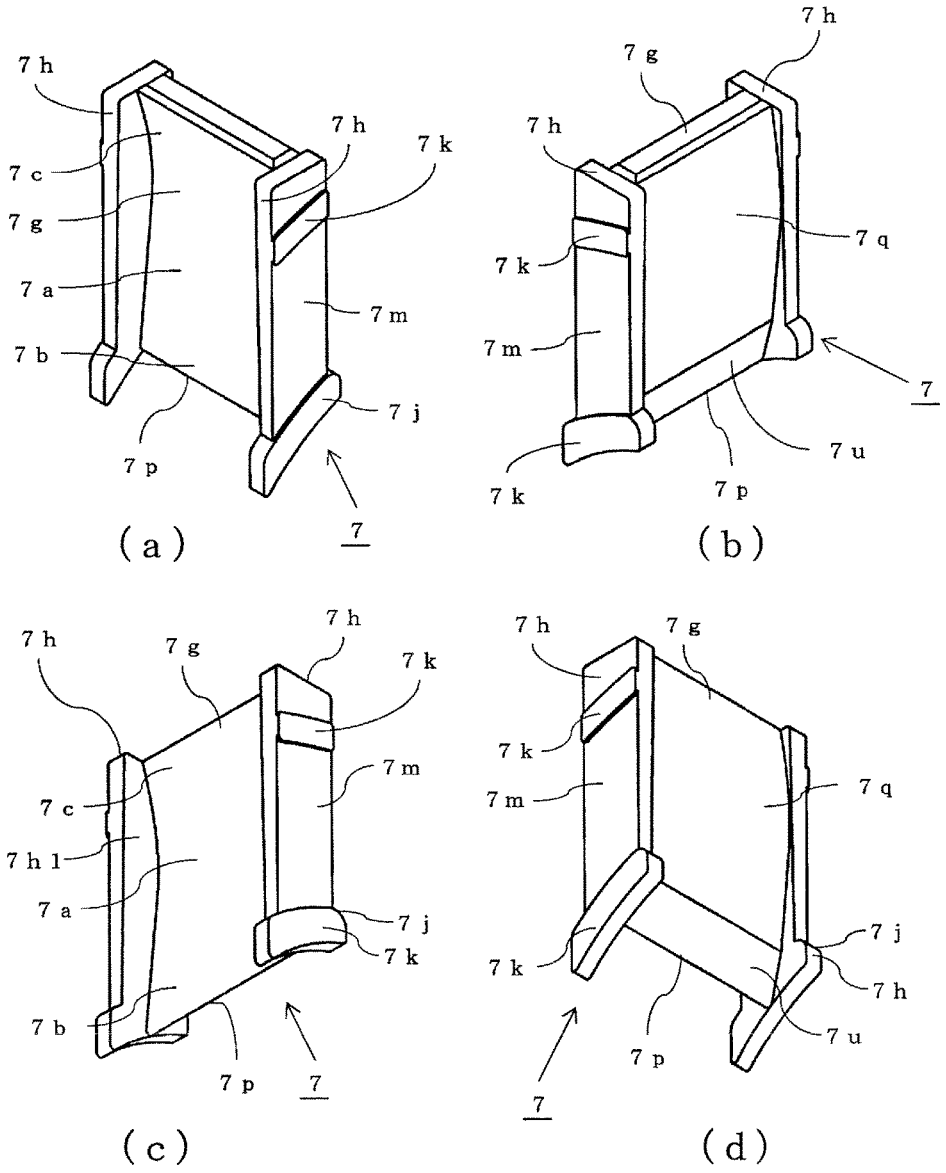
FIG. 11 is a perspective view of the blade shown in FIG. 10.

As shown in FIGS. 10 and 11, the projection surface 7*a* on the blades 7 has a first part 7*b*, being the inside part of the projection surface 7*a* in the radial direction, and a second part 7*c*, being the outside part of the projection surface 7*a*, positioned on the outside of the first part 7*b* in the radial direction. The blade 7 second part 7*c* is disposed as an integral part of the first part 7*b*, mediated by a bent or curved portion relative to the first part 7*b*. Note that in the example explained here, mediation is through a curved portion 7*d*.

In the same way as the above-described first part 3*b*, the first part 7*b* of the blades 7 is formed at a pitch so that its radial outer side is positioned further behind its inner side in the rotational direction R1. In the same way as the above-described second part 3*c*, the second part 7*c* is formed so that it is positioned further to the front in the rotational direction than an imaginary line extending the first part 7*b* outward.

The blades 7, like the blades 3 described above, have a blade projection portion 7*g* with a projection surface 7*a* for projecting projection material, and a pair of attachment portions 7*h* positioned on the two edge portions of this blade projection portion 7*g*. In the attachment portions 7*h*, at least the outside part 7*i* thereof is formed in a straight shape. The blade projection portion 7*g* has a curved or bent shape, but the majority of the outside part of the attachment portions 7*h* (the majority of the inside part described below) is considered as straight part 7*h*3.

The attachment portions 7*h* of the blades 7 have a locking portion 7*j* on the inside part thereof. The locking portion 7*j* is formed to protrude from the above-described straight shape. In addition, plurality of contacting portions 7*k* is disposed on the outside of the pair of attachment portions 7*h*. The contacting portions 7*k* are formed to project from the outside surface 7*m* of the attachment portions 7*h*. Note also that on the blades 7, the entire outer surface of the locking portion 7*j* is a contacting portion 7*k*. The blade projection portion 7*g* and attachment portions 7*h* are formed so that the spacing L9 of the inside surfaces 3*h*1 opposing the pair of attachment portions 3*h* becomes gradually smaller toward the outside compared to the inside (center direction) in the radial direction. The relationship between the outer surface 7*h*2 of attachment portions 7*h*, both edge portions 7*g*1 on the blade projection portion 7*g*, and so forth is also as explained above for the blades 3.

Also, as was the case for the above-described blades 3, the second part 7*c* of the blades 7 is formed so that the imaginary line connecting the rotational center of the blades 7 and a point close to the outside edge portion of the second part 7*c* matches the normal line, therefore the above-described projection material acceleration capability can be demonstrated. Here the imaginary line (same as the imaginary line L2 shown in FIG. 5 using blades 3) connecting the rotational center of the blades 7 and the outer end portion 7*n* of the second part 7*c* is formed to match the normal line.

The inner end portion 7*p* of the blade projection portion 7*g* on the blades 7 is formed in an inwardly tapered shape, as described above relative to the blades 3 and, by expanding the distance between the inner end portions 7*p* between each of the blades 7, can function as guide portions for increasing the amount of projection material guided between the rotating blades 7.

As described above, the blades 7 have essentially the same constitution as the blades 3, except for not having projecting portions and associated structures on the projection back surface 7*q*. The projection back surface 7*q* is formed in a curved shape (a curved shape without a bent portion) except for the taper-forming portion 7*u*. The taper-forming portion 7*u* forms the above-described first part 7*b* and the above-described tapered end portion 7*p*. Note that the taper-forming portion 7*u* here was formed in a planar shape, but it may also be formed in a curved shape, i.e. as a portion of the curved surface formed in the projection back surface 7*q*.

Using the centrifugal projector 1 and blades 7 used for same constituted as described above, the projection material projection pattern can be concentrated, and projection efficiency increased with respect to a narrow projection range. Parts of the blades 7 with the same constitution as the blades 3 provide the effects obtained from that constitution.

The same effects of the above-described blades 3, 7 themselves can be demonstrated even if, for example, the side plate unit, distributor, control cage, or other parts differ in constitution from what was described above. For example, for side plates used for both these blades 3 and 7, the side plate is not limited to the above-described pair of side plates, but may also be, for example, a single side plate.

Figure 12:
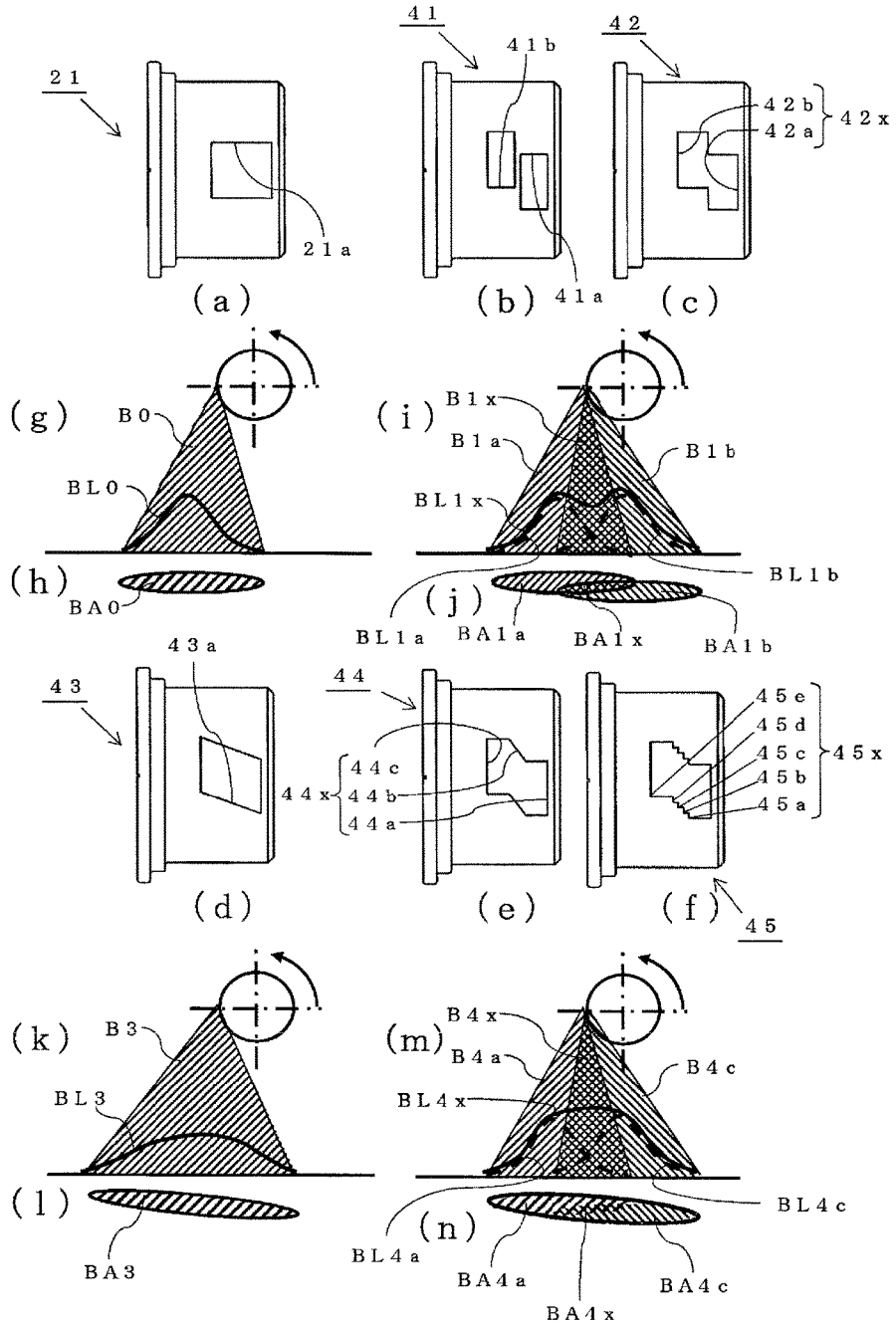
FIG. 12 is a diagram showing another example of a blade which can be used in a centrifugal projector according to an embodiment of the invention.

Next, referring to FIG. 12, we explain a variant example of a control cage used in a centrifugal projector 1. I.e., we explain a control cage, used simultaneously with the above-described blades 3, 7, from which a synergistic effect is obtained. The above-described control cage 21, as shown for example in FIG. 12(*a*), has a rectangular opening window 21*a*. The control cage used in the centrifugal projector 1 is not limited to the above.

The control cage used in the centrifugal projector 1 may have two or more opening windows selected from among square or triangular opening windows. In addition to having two or more opening windows selected from among square or triangular opening windows, it is also acceptable to have a single opening window formed as a single piece by partially overlapping all or a part of these opening windows. Examples mentioned here of squares include rectangles (rectangles or regular squares) or other parallelogram, etc. Specifically, the control cage 41 shown in FIG. 12(*b*) may be used as the control cage for the centrifugal projector 1.

The control cage 41 shown in FIG. 12(*b*) has two square opening windows 41*a* and 41*b*. Except for the constitution of the opening window, the control cage 41 comprises the same constitution as the above-described control cage 21, so a detailed explanation thereof is here omitted.

Here the advantages of FIG. 12(*b*), which is the example of a control cage from which a synergistic effect is obtained using the blades 3 and 7 simultaneously, are explained. In the step whereby projection material from the above-described control cage is scatter-released, projection material is supplied in a phase-differentiated manner from the opening windows 41*a*, 41*b*. This enables the composition of a projection pattern; uniform processing is applied to the processing targets, and the total amount of projection required for processing can be reduced.

Details of phase differentiation in the control cage opening window are now explained. Projection material is continuously released from the control cage opening window. Here, as shown in FIG. 12(*b*), the opening windows 41*a* and 41*b* are provided on the control gate 41; when positioned in the circumferential direction, an offset occurs in each of the respective projections, i.e., the offset positioning of the opening windows 41*a* and 41*b* results in a positional offset between the projection material which leaves the first opening window 41*a* and the projection material which leaves the second opening window 41*b*. That projection offset becomes a phase difference, which results in the composition of a projection pattern. I.e., in the shot scatter-release step of the centrifugal projection method when the control cage 41 is used, a phase difference (projection offset) in the scatter-released projection material is caused to occur by releasing projection material from two opening windows.

The composition of the pattern created by this control cage 41 can also be performed by blades other than the blades 3 or 7. However, if the original projection pattern is broad, the result will be merely a broad projection, even if the composition is offset therefrom, and no advantage will be gained. In general, a square opening window is used to narrow the original distribution (the distribution of the respective opening portions). Also, the supplying of projection material with a phase differential from the control cage can itself also be achieved by changing the shape of the opening window. For example, the shape of the control cage opening window may be made rectangular (rectangular or square). By so doing, the timing at which projection material is supplied from the control cage to the blades is simultaneous in the blade width direction. On the other hand, a method is also conceivable in which, by using a triangular or other shape for the opening window, the timing at which projection materials are supplied to the blades can be offset across the blade width direction. The present inventors have discovered that a parallelogram is preferable when processing a flat panel. As described above, the control cage 41 has good compatibility with the blades 3 and 7, which are able to concentrate and narrow the projection pattern. I.e., by composing a projection pattern concentrated by the blades 3, 7, the control cage 41 is able to increase the amount of projection within the total range of the processing target.

In other words, by composing a pattern using the above-described blades 3, 7 and the control cage 41, etc., a projection pattern fitting the product, which is the processing target, can be formed. Specifically, after gathering projection material on the blades to concentrate the projection pattern, any desired projection pattern may be set using a technology for composing distributions, such as the control cage 41, and the fraction of projection material resulting in processing variability or not hitting the product can be reduced.

A centrifugal projector 1 using a control cage 41 raises projection efficiency and achieves a reduction in the total amount of projection material required for product processing. I.e., if there is projected projection material which does not hit the product, or a larger fraction of projection material hits the product than required, then even if the projection material acceleration efficiency improves, there will be an increase in the total projection amount, and efficiency in performing the targeted processing cannot be said to rise very much. Depending on the product, there were some cases in which only about ⅕ of the projected projection material contributed to processing the product. A centrifugal projector 1 with these improved blades 3, 7 and control cage 41 has a dramatic effect.

Figure 13:
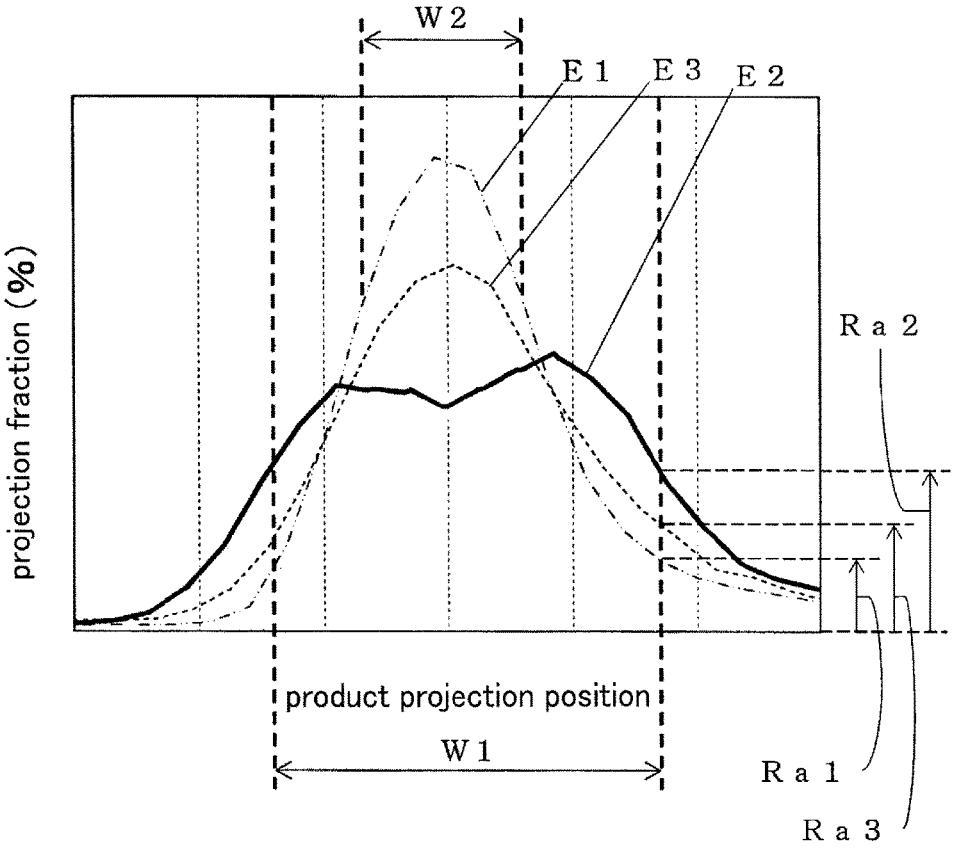
FIG. 13 is a diagram showing the distribution of projection ratios in centrifugal projectors according to test examples 1 and 2, and a comparative example of the present invention.

Here, referring to FIG. 13, the advantages of the blades 3, 7 and the control cage 41 using test examples are explained. FIG. 13 is a diagram showing what percentage of the total projected projection material is projected onto which part of the product (processing target). FIG. 13 may also be said to show the projection pattern relative to a product. The horizontal axis shows the product projection position. The vertical axis shows the projection fraction and percentage of total.

In FIG. 13, E3 shows the results of a comparative example. In the comparative example, results are shown using the above-described conventional blades, i.e., blades with a projection surface having an essentially flat surface (the surface on plane P1), and a control cage with a single opening window. E1 shows the results of test example 1. Test example 1 is the result obtained using the blades 3 shown in FIGS. 10 and 11 and a control cage (e.g. FIG. 12(*a*)) having a single opening window. E2 shows the results of test example 2. Test example 2 is a result obtained using the blades 3 and a control cage (e.g. FIG. 12(*b*)) having two opening windows. Note also that E1, E2, and E3 show test results.

In FIG. 13, W1 shows the product (processing target) range; i.e., the projection range on the product. Ra3 shows the minimum projection fraction within the range of a processing target in a comparative example. Ra1 shows the minimum projection fraction within the range of a processing target in test example 1. Ra2 shows the minimum projection fraction within the range of a processed part in test example 2.

In FIG. 13, the maximum value of the projection fraction in the test example 1 projection pattern is high compared to the projection pattern in the comparative example, while on the other hand the fraction is low in other parts, so it can be confirmed that the projection is concentrated.

When the rejection amount is equal, the processing time for the processed part lengthens in inverse proportion to the lowest projection fraction. When the product range is W1, Ra3>Ra1, therefore the processing time is shorter for the comparative example than for the test example 1. When composing a projection pattern such as that in example 2, there are two peaks within W1, and adjustment can be made to achieve an overall flat projection pattern. In the test example 2 case, Ra2>Ra3, and processing time is much shorter in test example 2 than in the comparative example. Note that in the comparative example, because the distribution is broad, overall efficiency is low even if there are two opening windows; i.e., shot not hitting the processed part increases and processing time increases further. This means that for processed parts such as those shown by W2, for example, projection efficiency is highest and processing time is shortened in test example 1.

In the W1 product case, as described above, test example 2 is most superior. Thus projection of the required amount of projection material onto the necessary parts means that processing time can be shortened and projection amounts can be reduced. Electrical power used for projection can thus be reduced, and furthermore power used to circulate shot can be reduced by reducing the amount of projection material in circulation; projection material abrasion can also be reduced. In addition, abrasion of projection material and of the liner caused by impact on the liner inside the projection chamber (a projection chamber in a surface treatment apparatus using a centrifugal projector 1) by projection material not hitting the product can also be reduced.

As described above, there is extremely good compatibility between a control cage with plurality of opening windows and the blades 3 and 7 which enable concentration of the above-described projection pattern. Also, with a control cage enabling the composition of such a projection pattern, and blades 3 and 7, the projection pattern of projection material can be concentrated and adjustments made to achieve a projection pattern appropriate to the processed part, thereby increasing projection efficiency. I.e., processing variability and projection material not hitting the processing targets can be reduced, as can the total amount of projected projection material.

Starting in FIG. 13, the projection amounts required for each product are determined according to set processing conditions. Ideally, if shot is uniformly projected onto the processed surface, one may say that the quality of the processed surface is also uniform and that no wasted projection occurs. In reality, however, because the projection pattern is not uniform, projection density differed between locations on the product, and processing variability occurred. Also, it could occurred that the large number of shot did not hit the product, and depending on the product and apparatus, less than 20% of the projected shot contributed to the quality of product processing. In response to this, projection efficiency can be raised using a centrifugal projector 1 comprising the above-described blades 3, 7 and control cage 41, and the centrifugal projection method using same.

Next, referring to FIG. 12, it is explained variant examples of the control cage used in a centrifugal projector 1 according to an embodiment of the present invention, as well as the operational effects of changes to the control cage. The control cage used simultaneously with the above-described blades 3, 7, from which a synergistic effect is obtained may also be the control cage 42, 43, 44, or 45 according to FIGS. 12(*c*)-(*f*), in addition to the above described FIG. 12(*a*), (*b*). Below we explain these control cages 42-45, but except for the constitution of the opening window, these comprise the same constitution as the above-described control cage 21, so a detailed explanation thereof is here omitted.

The control cage 42 shown in FIG. 12(*c*) has a single opening window 42*x*, integrated as a single piece by the partial overlapping of parts of two rectangular opening windows. The opening window 42*x* has rectangular parts 42*a*, 42*b* constituting a window. For example, the sizes of the rectangular parts 42*a*, 42*b* are assumed to be the same as the size of the opening windows 41*a*, 41*b*. The control cage 43 shown in FIG. 12(*d*) has a parallelogram-shaped opening window 43*a*.

The control cage 44 shown in FIG. 12(*e*) has rectangular and parallelogram-shaped opening windows and has three such opening windows, and has a single opening window 44*x* which is integrated into a single piece by the partial overlap of a portion of these opening windows. The opening window 44*x* has a rectangular part 44*a*, a parallelogram-shaped part 44*b*, and a rectangular part 44*c*, forming a window, and is integrated as a single piece, positioned in this order. The control cage 45 shown in FIG. 12(*f*) has five rectangular opening windows, and has an opening window 45*x*, integrally formed as a single piece by the partial overlap of a portion of these opening windows. The opening window 45*x* has a rectangular part 45*a*, a rectangular part 45*e*, and narrow width rectangular parts 45*b*, 45*c*, and 45*d* positioned between the above, together constituting a window. The sizes of the rectangular parts 45*a*, 45*e* are, for example, essentially the same as the sizes of the rectangular parts 44*a*, 44*c*. The positions and sizes of the area combining the rectangular parts 45*b*, 45*c*, and 45*d* are, for example, essentially the same as the positions and sizes of the parallelogram-shaped part 44*b*.

Next, referring to FIG. 12, it is explained variant examples of the control cage used in a centrifugal projector 1 according to an embodiment of the present invention, as well as operational effects of changing the control cage. Note that FIGS. 12(*a*)-12(*f*) are side elevations of a control cage with a cylindrical shape (diagrams show an opening window placed in the side surface); FIGS. 12(*g*)-12(*n*) show the case when the blades, etc. rotate in the direction of the arrow in FIG. 12 when the control cage shown in FIGS. 12(*a*)-12(*f*) is viewed from the left side (the hopper side), i.e. when blades passing through the window on each control cage rotate from down to up on the FIG. 12 paper surface.

First, the area through which projection material passes when the FIG. 12(*a*) control cage 21 is used is shown by B0 in FIG. 12(*g*); the area on the processed surface where projection material hits is shown by BA0 in FIG. 12(*h*), and the projection pattern (distribution) is shown by BL0 in FIG. 12(*g*). Note that "area on the processed surface where projection material hits" means the "area where projection material hits" assuming the processed surface is on a plane essentially perpendicular to the direction in which the projection material is projected. The opening window 21*a* shown in FIG. 12(*a*) is one in general use.

The area through which projection material passes when the FIG. 12(*d*) control cage 43 is used is shown by B3 in FIG. 12(*k*); the area on the processed surface where projection material hits is shown by BA3 in FIG. 12(*l*), and the projection pattern (distribution) is shown by BL3 in FIG. 12(*k*). The opening window 43 shown in FIG. 12(*d*) is a parallelogram; since the timing at which projection material is supplied from the control cage 43 to the blades is offset in the width direction of the blades, the projection pattern is softened. The processing target processing time lengthens in inverse proportion to the lowest projection fraction, therefore depending on the shape of the product this may be more advantageous than the case of FIG. 12(*a*).

In other words, the control cage 43 has a parallelogram-shaped opening window 43*a*; in the parallelogram of this opening window 43*a*, because the position in the circumferential direction is offset from the position in the direction parallel to the rotary shaft of the mutually opposing sides formed in the circumferential direction, the positional relationship seen on the side of the control cage 43 (the positional relationship shown in FIG. 12(*d*)) is one of diagonal alignment, therefore an appropriate projection pattern is obtained. This constitution, by its use together with the concentrating performance of the blades 3, 7, has the effect of increasing projection efficiency relative to the product. Additionally, by applying the same thought as applied when providing this parallelogram, it is also acceptable to provide a triangular opening window, or to provide an opening window combining a triangular opening window and a square opening window, or an opening window integrating parts thereof into a single entity.

The areas through which projection material passes when the FIGS. 12(*b*) and (*c*) control cages 41, 42 are used are shown by B1*a*, B1*b* in FIG. 12(*i*); the areas hit by the projection material on the processed surface are shown by BA1*a*, BA1*x*, and BA1*b* in FIG. 12(*j*), and the projection pattern (distribution) is shown by BL1*x* in FIG. 12(*i*). Area B1*a*, projection pattern BL1*a*, and area BA1*a* correspond to the opening window 41*a* (rectangular part 42*a*). Area B1*b*, projection pattern BL1*b*, and area BA1*b* correspond to the opening window 41*b* (rectangular part 42*b*). The overlapping part of areas B1*a*, B1*b* is area B1*x*. The overlapping part of areas BA1*a*, BA1*b* is area BA1*x*. The synthesis (adding together) of projection pattern BL1*a* and BL1*b* is the projection pattern BL1*x*, which may be described as the projection pattern when these control cage 41 and 42 are used.

The control cages 41, 42 have two or more opening windows, or have a single opening window integrating two or more opening windows, therefore the projection pattern can be adjusted to a desired pattern by composing the projection pattern. The processing target processing time lengthens in inverse proportion to the lowest projection fraction, therefore depending on the shape of the product this may be more advantageous than the cases of FIG. 12(*a*) and FIG. 12(*d*).

In other words, the control cages 41, 42 either have two rectangular opening windows 41*a*, 41*b*, or have two rectangular opening windows (rectangular parts 42*a*, 42*b*) and have a single opening window 42*x* integrating a partial overlap of those windows. Because the position in the circumferential direction and the position in the direction parallel to the rotary shaft are offset in the two rectangles (opening windows 41*a*, 41*b*) (rectangular parts 42*a*, 42*b*), the positional relationship (positional relationship in FIGS. 12(*b*), 12(*c*)) seen in the side surfaces of the control cages 41, 42 is one of diagonal alignment, therefore an appropriate projection pattern (desired projection pattern) is obtained. This constitution, by its use together with the concentrating performance of the blades 3, 7, has the effect of increasing projection efficiency relative to the product.

The areas through which projection material passes when the FIGS. 12(*e*) and (*f*) control cages 44, 45 are used are shown by B4*a*, B4*b*, B4*x*, and B4*c* in FIG. 12(*m*); the areas hit by the projection material on the processed surface are shown by BA4*a*, BA4*x*, and BA4*c* in FIG. 12(*n*), and the projection pattern (distribution) is shown by BL4*x* in FIG. 12(*m*). Area B4*a*, projection pattern BL4*a*, and area BA4*a* correspond to opening window 44*a* (rectangular part 45*a*). Area B4*c*, projection pattern BL4*c*, and area BA4*c* correspond to opening window 44*c* (rectangular part 45*e*). The overlapping part of areas B4*a*, B4*c* is area B4*x*. The overlapping part of areas BA4*a*, BA4*c* is area BA4*x*. The synthesis (adding together) of projection pattern BL4*a* and BL4*c* is a projection pattern BL4*x*, which may be described as the projection pattern when these control cage 44 and 45 are used.

The control cages 45, 45 have a single opening window integrating three or more opening windows, therefore the projection pattern can be adjusted to a desired pattern by composing the projection pattern. Specifically, the projection pattern BL1*x* described using FIG. 12(*i*) forms an M shape; i.e., the projection fraction is slightly less in the part between two peaks. By placement of a parallelogram part 44*b* in the case of FIG. 12(*e*), or placement of plurality of rectangular parts 45*b*, 45*c*, and 45*d* in the case of FIG. 12(*f*), between the rectangular parts 44*a*, 44*c* (rectangular parts 45*a*, 45*e*) corresponding to the opening windows 41*a*, 41*b* (rectangular parts 42*a*, 42*b*) in FIGS. 12(*b*) and (*c*), the projection fraction of the part between the two peaks can be adjusted upward. The processing time of processing target lengthens in inverse proportion to the lowest projection fraction, therefore depending on the shape of the product this may be more advantageous than the FIG. 12(*a*) through FIG. 12(*d*) cases. Also, a projection pattern can be obtained in which processing variability is reduced as much as possible.

In other words, the control cage 44 has a single integrated opening window 44*x* in which three squares (parts 44*a*, 44*b*, 44*c*) are partially overlapped. In the positional relationship seen on the side of the control cage 44*x* (positional relationship in FIG. 12(*e*)), The opening window 44*x* has a diagonally aligned first rectangular part 44*a* and a second rectangular part 44*c*, and a parallelogram part 44*b* placed between the first rectangular part 44*a* and the second rectangular part 44*c*. The first rectangular part 44*a*, the second rectangular part 44*c* and the parallelogram part 44*b* are respectively offset in positions in the circumferential direction and positions in the direction parallel to the rotary shaft. By this constitution, an appropriate projection pattern (desired projection pattern) is obtained. This constitution, by its use together with the concentrating performance of the blades 3, 7, has the effect of increasing projection efficiency relative to the product.

The control cage 45 has a single integrated opening window 45*x* in which five squares (this is explained as having parts 45*a* through 45*e*, but the same effect is demonstrated by partially overlapping four or more squares). In the positional relationship seen on the side of the control cage 45 (the positional relationship in FIG. 12(*f*)), the opening window 45 has a diagonally aligned first rectangular part (45*a*) and a second rectangular part (45*e*), and a rectangular part group formed of plurality of rectangular parts 45*b*, 45*c*, and 45*d* placed between the first rectangular part (45*a*) and second rectangular part (45*e*); this first rectangular part (45*a*), second rectangular part (45*e*), and rectangular part group formed of plurality of rectangular parts 45*b*, 45*c*, and 45*d* are respectively offset in their rotational direction positions and their positions in the direction parallel to the rotary shaft. In addition, the rectangular part group formed of plurality of rectangular parts 45*b*, 45*c*, and 45*d* are also offset in their rotational direction positions and their positions in the direction parallel to the rotary shaft, and are formed to line up diagonally when viewed on the side of the control cage 45. The rectangular parts 45*b*, 45*c*, and 45*d* which comprise this rectangular part group are formed so that their length in the direction parallel to the rotary shaft is smaller than the first rectangular part and the second rectangular part (45*a*, 45*e*). By this constitution, an appropriate projection pattern (desired projection pattern) is obtained. This constitution, by its use together with the concentrating performance of the blades 3, 7, has the effect of increasing projection efficiency relative to the product.

As described above, a control cage having either two or more opening windows, or a having two or more opening windows and having a single opening window integrated by the partial overlap of either the entirety of these opening windows or respective parts thereof, is capable of adjusting the projection pattern. The control cage produces the synergistic effect of blades 3 and 7, which concentrate the projection pattern; in other words it is capable of increasing the projection amount in the overall range of the processing target. It also reduces product processing variability and reduces the fraction of projection material not hitting the product, raising the projection material projection efficiency.

What is claimed is:

1. A centrifugal projector for projecting shot blast materials at a processing target, comprising:

a pair of side plates configured to rotate about a rotation axis in a first direction;

a plurality of cylindrical joining members arranged to secure the pair of side plates in parallel to each other;

a plurality of blades attached to the pair of side plates for rotation along with the pair of side plates;

a stationary control cage disposed in a center portion of the pair of side plates radially inwardly from the plurality of blades, the stationary control cage having an outer peripheral surface formed with an opening therein, wherein the stationary control cage is configured to deliver the shot blast materials out of the opening into between the plurality of blades;

a distributor disposed inside of the control cage for rotation with the pair of side plates, the distributor configured to mix the shot blast materials and supply the mixed shot blast materials to the control cage;

a rotary shaft driven to rotate in the first direction the pair of side plates, the plurality of cylindrical joining members, the plurality of blades and the distributor;

wherein the plurality of blades are each inclined from a line radially extending through the rotational axis and a base end of the blade in a second direction opposite to the first direction so that a radial outer side the blade is positioned further rearward in the second direction than a radial inner side of the same blade, each blade has a front surface facing in the first direction and used to throw the shot blast materials at the processing target and a back surface facing the second direction, the back surface being formed with (i) a raised portion projecting in the second direction and (ii) a curved surface forming a slope on a radially outer side of the raised portion, a respective cylindrical joining member being in abutment with the curved surface formed in the back surface of the blade, wherein a respective cylindrical joining member is positioned relative to the blade, with which the cylindrical joining member is in abutment, so that an imaginary plane running, in parallel to the rotational axis, through the base end of the blade and a tip of the raised portion goes through inside of the cylindrical joining member between a center axis of the cylindrical joining member and a circumferential surface of the cylindrical joining member opposite to a circumferential surface of the cylinder joining member being in abutment with the curved surface formed in the back surface of the blade, and the outer peripheral surface of the stationary control cage is formed with one or more square or triangular windows, or formed with a single opening window formed from two or more square or triangular openings at least partially overlapped with each other.

2. The centrifugal projector according to claim 1, wherein the opening window formed in the outer peripheral surface of the control cage is selected from among rectangular or parallelogram quadrilateral opening windows.

3. The centrifugal projector according to claim 2, wherein the front surface of each blade is bifurcated along a radial direction into a first front surface and a second front surface located radially outward of the first front surface, and the first front surface is further bifurcated along the radial direction into a first sub-front surface and a second sub-front surface located radially outward of the first sub-front surface, and the first and second sub-front surfaces are formed inclined so that the second sub-front surface is located further in the direction opposite to the rotational direction than the first sub-front surface, and the first and second front surfaces are formed inclined so that the second front surface is located further in the rotational direction than an imaginary line running in the radial direction in tangent with the first front surface.

4. The centrifugal projector according to claim 3, wherein each blade is formed with a pair of planar side walls having front edges and rear edges and extending perpendicularly to the rotational axis through a radial length of the blade along circumferential sides of the front surface, the front edges being shaped straight throughout its radial length and projecting generally in the first direction from the circumferential sides of the front surface, the rear edges being shaped straight in parallel to the front edges except radially inner end portions thereof from which locking portions project in the second direction.

5. The centrifugal projector according to claim 4, wherein the second front surface of the blade is formed so that an imaginary line (L2) connecting the rotation axis and a radially outer end of the second front surface runs in tangent with the second front surface.

6. The centrifugal projector according to claim 5, wherein each blade projection portion of the blade has a base portion near a radially inner end of the blade projection portion, wherein the base portion tapers so that a thickness of the base portion measured in the first direction becomes narrower towards the radially inner end of the blade projection portion, and each base portion serves as a guide portion to direct the shot blast materials into between two adjacent blades.

7. The centrifugal projector according to claim 4, wherein the rear edges being shaped straight in parallel to the front edges except s thereof from which locking portions project in the second direction the locking portions are each formed by a projection standing in the second direction from the radially inner end portion of the rear edge.

8. The centrifugal projector according to claim 1, wherein the control case has an insertion opening portion configured to receive the distributor therethrough from a side opposite to the rotary shaft, and the control cage has a cover disposed to cover a radial outer part of the distributor on a side of the rotary shaft; and the centrifugal projector further comprises a hopper positioned on the side opposite to the rotary shaft of the control cage, the hopper configured to supply the shot blast materials to the distributor, and the central projector further comprises a bracket fixed between the hopper and the control cage, the bracket filling a gap between the hopper and the control cage and preventing the shot blast materials from releasing outside from the gap.

9. The centrifugal projector according to claim 3, wherein the control cage is formed with two separate rectangular opening windows, or a single opening window formed by two rectangular opening windows partially overlapped with each other, and the two separate rectangular opening windows are positioned side-by-side in an axial direction of the control cage and staggered in a circumferential direction of the control cage.

10. The centrifugal projector according to claim 3, wherein the control cage is formed with a single opening window formed by three rectangular opening windows partially overlapped with each other, and the single opening window has a first rectangular part, a second rectangular part, and a parallelogram part disposed between the first rectangular part and the second rectangular part, the first rectangular part, the second rectangular part and the parallelogram part being diagonally aligned in the outer peripheral surface of the control cage in an axial direction of the control cage.

11. The centrifugal projector according to claim 3, wherein the control cage is formed with a single opening window formed by four or more rectangular opening windows partially overlapped with each other, the single opening window has a first rectangular part, a second rectangular part, and a connecting part connecting the first and second rectangular part, the connecting part being formed with a series of rectangular parts diagonally disposed between the first rectangular part and the second rectangular part with two adjacent rectangular parts being overlapped with each other; and the series of rectangular parts are formed is shorter in an axial direction than the first rectangular part or the second rectangular part.

* * * * *